US006267566B1

(12) United States Patent
Konishi et al.

(10) Patent No.: US 6,267,566 B1
(45) Date of Patent: Jul. 31, 2001

(54) OIL PUMP

(75) Inventors: Hideo Konishi; Toyoji Takebuchi, both of Saitama (JP)

(73) Assignee: Jidosha Kiki Co., Ltd., Tokyo (JP)

( * ) Notice: Subject to any disclaimer, the term of this patent is extended or adjusted under 35 U.S.C. 154(b) by 0 days.

(21) Appl. No.: 09/337,711

(22) Filed: Jun. 21, 1999

(30) Foreign Application Priority Data

Jun. 23, 1998 (JP) ..... 10-175900
Sep. 25, 1998 (JP) ..... 10-271951

(51) Int. Cl.[7] ..... F04B 49/00
(52) U.S. Cl. ..... 417/310
(58) Field of Search ..... 417/310, 307, 417/279; 137/115.01

(56) References Cited

U.S. PATENT DOCUMENTS 4,408,964 * 10/1983 Mochizuki et al. ..... 417/310
5,098,259 * 3/1992 Ohtaki et al. ..... 417/308
5,161,959 * 11/1992 Gettel ..... 417/300
5,209,648 * 5/1993 Ishizaki et al. ..... 417/310
5,226,802 * 7/1993 Nakamura et al. ..... 417/299
5,290,155 * 3/1994 Snow et al. ..... 418/82
5,513,960 * 5/1996 Uemoto ..... 417/300
5,800,135 * 9/1998 Merz ..... 417/300

FOREIGN PATENT DOCUMENTS 52-10202 3/1977 (JP) .
5-96483 12/1993 (JP) .
8-291793 11/1996 (JP) .

* cited by examiner

*Primary Examiner*—Teresa Walberg
*Assistant Examiner*—Daniel Robinson
(74) *Attorney, Agent, or Firm*—Townsend and Townsend and Crew LLP; Kenneth R. Allen

(57) ABSTRACT

An oil pump includes pump constituent elements, a pump body, and a driving shaft. The pump constituent elements define a pump chamber between a rotor and a cam ring that houses the rotor. The pump body is constituted by a front body and a rear body. The front body defines a housing space for housing the pump constituent elements. The driving shaft extends through and is axially supported by the front body to rotatably drive the rotor. An annular space is formed around the driving shaft in the front body, between a bearing for rotatably driving the driving shaft of the front body, and the pump chamber of the pump constituent elements. A flow control valve is placed in the annular space to return part of a pump discharge fluid from the pump chamber to a pump suction side.

14 Claims, 19 Drawing Sheets

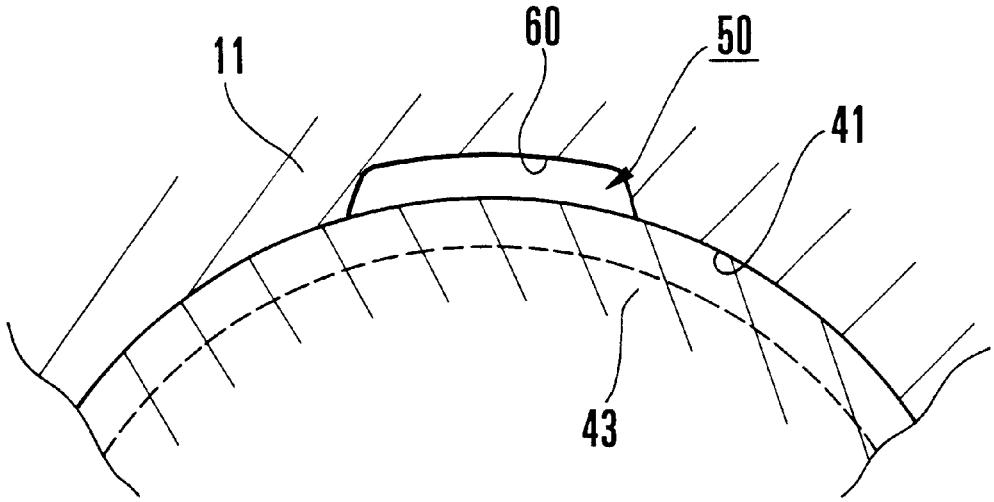
FIG. 10
FIG. 11A
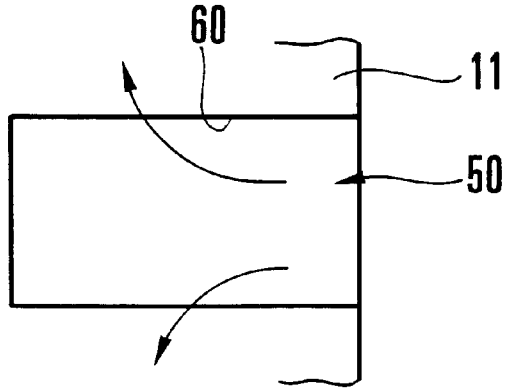
FIG. 11B
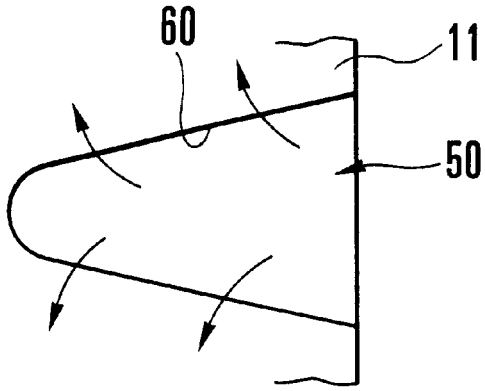

OIL PUMP

BACKGROUND OF THE INVENTION

The present invention relates to an oil pump and, more particularly, to an oil pump of a type used as a hydraulic pressure generating source by a power steering device or the like for decreasing the force required to operate the steering wheel of a vehicle.

As an oil pump serving as a hydraulic pressure generating source for a hydraulic power steering device driven by a vehicle engine, a vane pump having a spool type flow control valve is generally known. A vane pump of this type has, in a housing space formed in its pump body, pump constituent elements comprised of a rotor, a cam ring, and a pressure plate and a side plate (or the inner surface portion of the pump body). The rotor has vanes. The cam ring houses the rotor to form a pump chamber. The pressure plate and side plate are arranged on the two sides of the rotor and cam ring to come into contact with each other. This pump constituent elements is placed in the housing space in the pump body. The rotor is axially supported by the inner end of an axially supported driving shaft extending from the outside of the pump body. Rotation of the engine is transmitted to the rotor to drive it.

When the rotor is rotatably driven by the driving shaft, the working fluid flows from the suction port of the pump to be taken into the pump chamber through a suction path formed in the pump body, and is sent from the discharge port to the discharge pressure chamber. The working fluid flows as hydraulic oil having a predetermined pressure from the discharge pressure chamber and is discharged from the discharge port through the discharge path. The spool type flow control valve is actuated when pressures before and after a restrictor formed on part of the discharge path are introduced to it.

When the flow control valve is actuated, a discharge fluid flowing in the discharge path is divided into an excessive fluid and a supply fluid which is to be supplied to the power steering device in accordance with the movement of the spool. The excessive fluid is connected to the suction side (or a tank) through a suction path and returned to it.

Generally, in most conventional spool type flow control valves of this type, the spool is disposed at a portion close to the outer surface of the pump body housing the pump constituent elements, to be displaceable in a direction perpendicular to the driving shaft (see Japanese Utility Model Laid-Open No. 5-96483 and Japanese Patent Laid-Open No. 8-291793).

In the vane pump described above, since the flow control valve is incorporated in the pump body at a portion close to the outer circumferential portion of the body and the spool actuates in a direction different from the axial direction of the pump driving shaft, it is difficult to make the entire pump compact.

In the conventional vane pump described above, when the engine operates at a high rotational speed, most fluid discharged from the pump chamber becomes excessive. Accordingly, the return path required to return the excessive fluid to the suction side with the flow control valve must have a large path diameter, increasing the size of the entire pump. The longer the path, the larger the path resistance produced by the return path described above, thus increasing the power loss of the pump.

Conventionally, an oil pump in which a flow control valve is arranged in the pump body to be movable in the axial direction is also known, as shown in, e.g., Japanese Patent Publication No. 52-10202.

In the oil pump of this type, as the flow control valve is provided on the extension of the axis of the pump driving shaft, the size of the pump in the axial direction increases. The entire structure including the path structure in the pump body becomes complicated to pose problems in terms of machinability and assembly of the respective portions as well.

What should be solved in the oil pump of this type is how to form a path structure in the pump efficiently, thereby improving the operation efficiency of the pump.

For example, in the conventional oil pump, when the flow rate of the discharge fluid discharged from the pump chamber reaches a predetermined value or more, the discharge fluid is partly returned as the excessive fluid to the pump suction side with the flow control valve formed at part of the pump discharge path. In the conventional oil pump, since the flow control valve is provided at a position remote from the pump chamber in the pump body, the return path required for returning the excessive fluid to the pump suction side becomes long. Since the return path has a small sectional area, a large path resistance acts on the excessive fluid. The large path resistance causes a large pressure loss of the excessive fluid. Since the fluid temperature (oil temperature) of the working fluid increases, the power loss in driving the power is large, leading to a low operation efficiency of the pump.

Of the discharge fluid discharged from the pump chamber, the excessive fluid is returned to the pump suction side with the flow control valve. To return the excessive fluid from the pump discharge side to the suction side, the path structure must be appropriately designed.

More specifically, when the rotational speed of the pump is low, the flow rate of the excessive fluid is small, and the flow velocity is also low. Even when the excessive fluid is merged with the suction fluid from the tank midway along the path, it is taken into the suction side of the pump chamber. At this time, the in-flow movement of the suction fluid and excessive fluid to the suction side of the pump chamber is not interfered with.

In contrast to this, when the rotational speed of the pump increases to reach a high speed, the flow rate of the excessive fluid from the pump discharge side increases in proportion to the rotational speed, and also the flow velocity increases. If the excessive fluid is merely merged with the suction fluid midway along the suction path, the flow of the suction fluid from the tank is interfered with at this merge portion by the jet of the excessive fluid. Then, the suction flow rate to the suction side of the pump chamber becomes insufficient to form a negative-pressure region, causing cavitation to likely generate noise. Any countermeasure is sought for to prevent this problem.

SUMMARY OF THE INVENTION

It is, therefore, a principal object of the present invention to provide an oil pump in which the return path structure is simplified and shortened to decrease wasteful power loss, so that the operation efficiency of the pump is improved over that of a conventional one.

It is, therefore, another object of the present invention to provide an oil pump which is entirely made compact.

It is still another object of the present invention to provide an oil pump in which the entire pump structure is simplified to reduce the manufacturing cost.

It is still another object of the present invention to provide an oil pump capable of preventing cavitation generated when the excessive fluid to be returned to the suction side with, e.g., the flow control valve and the suction fluid from the tank are merged, and resultant noise.

In order to achieve the above objects, according to the present invention, there is provided an oil pump comprising pump constituent elements constituted by a rotor, a cam ring for housing the rotor to define a pump chamber together with the rotor, and a pressure plate disposed at least on one side of the rotor and the cam ring, a pump body constituted by a front body, which defines a housing space for housing the pump constituent elements, and a rear body, and a driving shaft extending through and axially supported by the front body to rotatably drive the rotor, wherein an annular space is formed around the driving shaft in the front body on a front side of the housing space, and a flow control valve is placed in the annular space to return part of a pump discharge fluid from the pump chamber to a pump suction side.

BRIEF DESCRIPTION OF THE DRAWINGS

FIGS. 4A and 4B show a retainer used in the oil pump of FIGS. 1 to 3, in which FIG. 4A is a side view, and FIG. 4B is a sectional view taken along the line IV—IV of FIG. 4A;

FIG. 10 is a sectional view of the main part for explaining a restrictor in the oil pump shown in FIG. 6;

FIG. 11A is a schematic view for explaining the shape of the restrictor, and FIG. 11B is a view showing a modification of the shape of the restrictor;

FIGS. 13A and 13B show the cylindrical member of FIGS. 9 and 12 in detail, in which FIG. 13A is a side view, and FIG. 13B is a sectional view taken along the line XIII—XIII of FIG. 13A;

FIGS. 17A to 17C show a partition plate stacked on the opposite side of the pressure plate to the pump chamber, in which FIG. 17A is a plan view, FIG. 17B is a sectional view taken along the line b—b of FIG. 17A, and FIG. 17C is a sectional view taken along the line c—c of FIG. 17A;

DESCRIPTION OF THE PREFERRED EMBODIMENTS

FIGS. 1 to 5C show an oil pump according to an embodiment of the present invention, particularly one applied to a vane pump.

Figure 1:
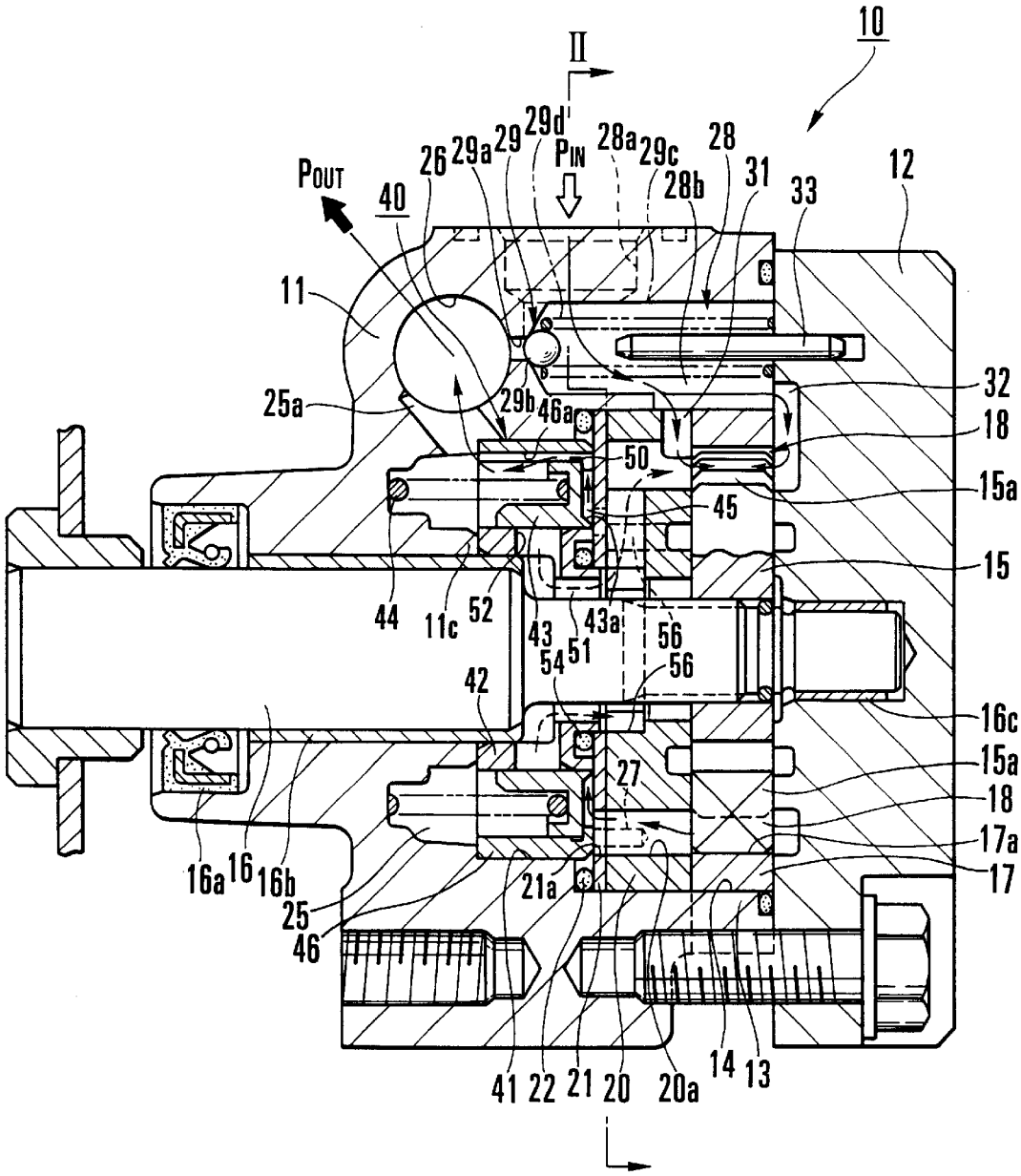
FIG. 1 is a longitudinal sectional view for explaining the main part of the entire portion of an oil pump according to an embodiment of the present invention.

Referring to FIGS. 1 to 5C, a vane pump denoted by reference numeral 10 has a pump body constructed of a front body 11 and a rear body 12 respectively located on the left and right sides in FIG. 1. For the sake of illustrative convenience, the front side is where the front body 11 of the pump body is provided, and is a driven end side in the axial direction of a driving shaft 16 to be described later. The rear side is where the rear body 12 of the pump body is provided, and is an end portion side opposite to the driven end in the axial direction of the driving shaft 16.

The front body 11 forms a substantially cup-like shape. A housing space 14 for housing pump constituent elements 13 is formed in the front body 11. The front body 11 has an end which opens backward. The front body 11 is combined with the rear body 12 to close the opening end of the housing space 14, so that the front body 11 and rear body 12 are integrated to form the pump body.

The driving shaft 16 for externally, rotatably driving a rotor 15 serving as the rotary element of the pump constituent elements 13 extends through the front body 11, and is rotatably supported by the front body 11 through a bearing 16*b* (a bearing bush in this case). A bearing 16*c* is comprised of a bush to axially support the inner end portion of the driving shaft 16 on the rear body 12.

An oil seal 16*a* is provided to hold the driving shaft 16 at the open end portion of the front body 11.

A cam ring 17 has a substantially elliptic inner cam surface 17*a* to house the rotor 15 having vanes 15*a*. The cam surface 17*a* and rotor 15 define a pair of pump chambers 18. The cam ring 17 and the rotor 15 having the vanes 15*a* constitute a pump cartridge.

A pressure plate 20 is stacked on the front body 11 of the pump cartridge to press against it. A partition plate 21 is stacked on the front body 11 side of the pressure plate 20. The plates 20 and 21, and the pump cartridge serve as the pump constituent elements 13.

As shown in FIG. 1, the pump constituent elements 13 are housed in the housing space 14 of the front body 11, and the end face of the pump cartridge on the rear body 12 side abuts against the inner surface of the rear body 12 that closes the housing space 14.

An O-ring 22 is interposed between the step of the housing space 14 on the front body 11 side and the partition plate 21. The front body 11 and the rear body 12, the bodies 11 and 12 and the cam ring 17, and the cam ring 17 and the plates 20 and 21 are positioned in the rotational direction by appropriate positioning pins or the like.

A discharge pressure chamber 25 is annularly formed in the housing space 14 of the front body 11 on the front side. The discharge pressure chamber 25 exerts a pump discharge pressure to the pressure plate 20 through a flow control valve (to be described later). A discharge path 25*a* guides the pump discharge fluid from the discharge pressure chamber 25. A discharge path 26 connects the discharge path 25*a* to a discharge port 26*a* (see FIG. 2).

Through holes (to be referred to as discharge paths hereinafter) 20*a* and 21*a* are respectively formed in the pressure plate 20 and partition plate 21 to serve as discharge paths for connecting the hydraulic oil from the pump chambers 18 to the discharge pressure chamber 25. A positioning pin 27 positions the pressure plate 20 and partition plate 21, thereby aligning the discharge paths 20*a* and 21*a* with each other.

Figure 2:
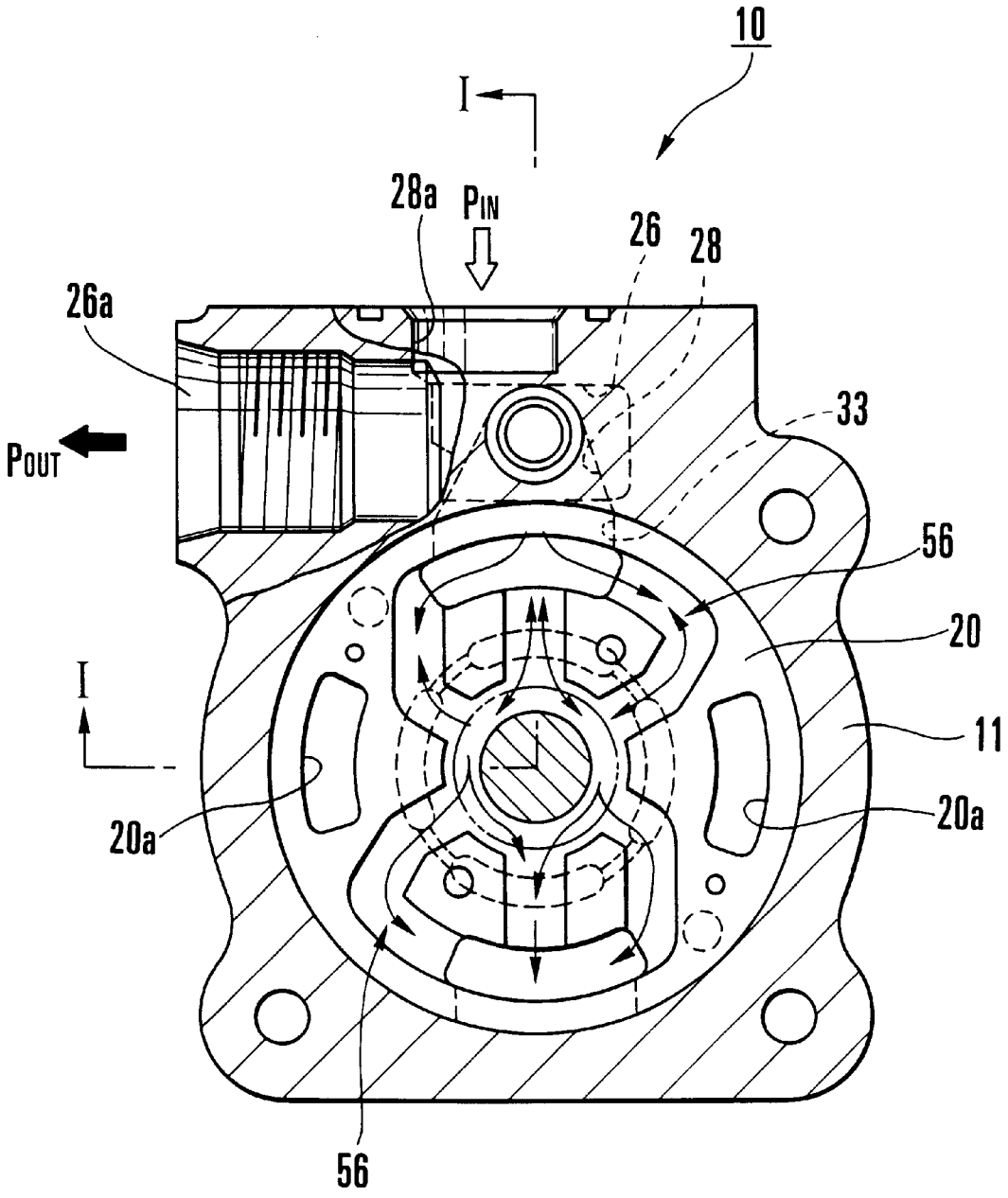
FIG. 2 is a sectional view taken along the line II—II of FIG. 1.

A pump suction path 28 is formed in the front body 11 to guide the suction fluid from a suction port 28*a* formed in part of the front body 11 to the pump chambers 18. As shown in FIGS. 1 and 2, the suction path 28 is connected to suction paths 31 and 32, respectively formed in the pressure plate 20 and rear body 12, through a path portion 28*b*.

The suction path 28 and path portion 28*b* are formed in the front body 11 as cored holes. A pin 33 serves as a positioning means when positioning the front body 11 and rear body 12 in the rotational direction and incorporating a relief valve 29.

A relief valve 29 is interposed between the suction path 28 and discharge path 26 described above and actuates when the fluid pressure in the discharge path 26 becomes equal to a predetermined value or more. The relief valve 29 is constituted by a ball 29*b* and a coil spring 29*c*. The ball 29*b* opens/closes a hole 29*a* through which the two paths 28 and 26 communicate with each other. The coil spring 29*c* applies a predetermined preset pressure to the ball 29*b*. Reference numeral 29*d* denotes the spring retainer of the coil spring 29*c*, as shown in FIG. 1. The spring retainer 29*d* is not always necessary and can be omitted.

The suction path 31 formed in the pressure plate 20 is guided downward in FIG. 1 via a two-forked path bypassing a portion where the driving shaft 16 extends. The suction path 32 formed in the rear body 12 is guided to the suction region in the upper portion in FIG. 1 to guide the working fluid to the respective suction regions of the pump chambers 18. The suction paths 31 and 32 are not illustrated in detail.

A flow control valve 40 controls the flow rate of the pump discharge fluid and returns the excessive fluid to the pump suction side or tank side.

According to the present invention, an annular space 41 is formed, around the driving shaft 16, in the front body 11 on the front side of the housing space 14. The flow control valve 40 is formed in the annular space 41 to return part of the pump discharge fluid discharged from the pump chambers 18 in the pump constituent elements 13 to the pump suction side.

The annular space 41 is formed, between the housing space 14 formed in the front body 11 to house the pump constituent elements 13 and the discharge pressure chamber 25 formed in the front body 11 on the front side, midway along a path that guides the pump discharge fluid discharged from the pump chambers 18. In other words, the annular space 41 constituting the flow control valve 40 is formed in the front body 11 on the front side of the housing space 14 for housing the pump constituent elements 13, in the axial direction of the driving shaft 16. A space constituting the discharge pressure chamber 25 is formed in the front body 11 on the front side to communicate with the annular space 41.

The flow control valve 40 is constituted by a cylindrical member 42, an annular valve body 43, and a coil spring 44. The cylindrical member 42 is fitted on the driving shaft 16. The annular valve body 43 is placed on the outer surface of the cylindrical member 42 to be movable in the axial direction. The coil spring 44 serves as a biasing means for biasing the annular valve body 43 toward the rear side in the axial direction.

An annular projection 43*a* extends vertically from a rear-side side surface portion, close to the inner periphery, of the annular valve body 43. The projection 43*a* and the partition plate 21 define a gap 45. The pump discharge fluid discharged from the pump chambers 18 is guided to the gap 45 through the discharge paths 20*a* and 21*a* respectively formed in the pressure plate 20 and partition plate 21.

Figure 4A:
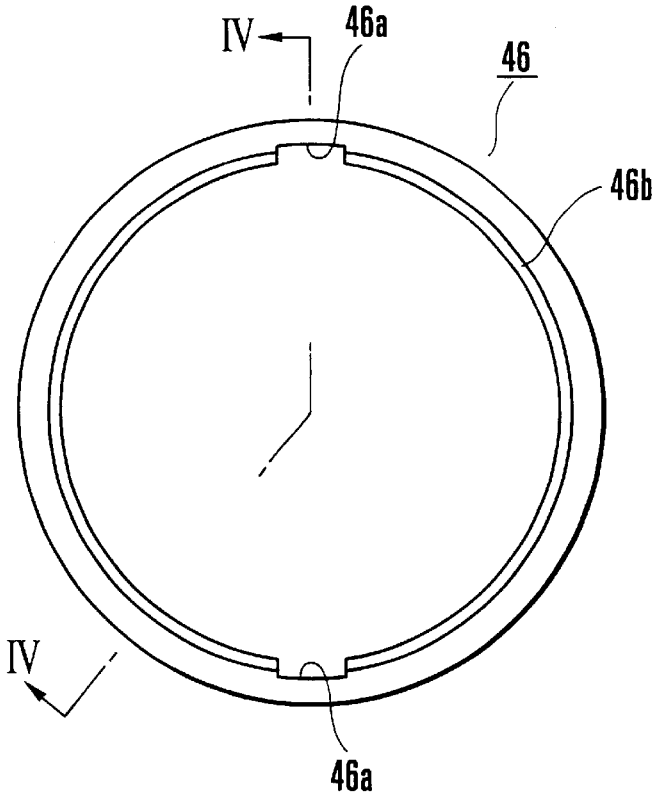
Figure 4B:
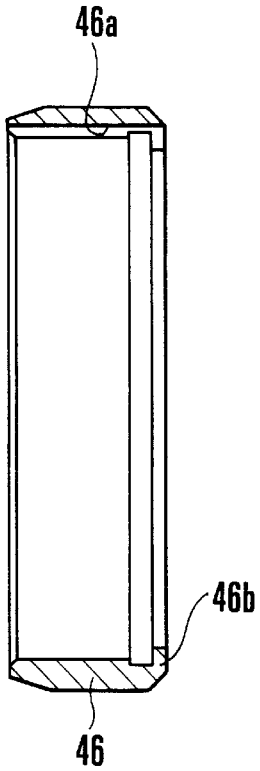

A retainer 46 formed to have a shape as shown in FIG. 4A is fitted in the annular space 41 of the front body 11, and the annular valve body 43 is slidably held in the retainer 46. Grooves 46*a* are formed at two portions in the inner surface of the retainer 46 to extend in the axial direction. A restrictor 50 serving as a metering orifice is formed between the grooves 46*a* and the outer surface of the annular valve body 43.

In FIG. 4A, a step 46*b* is formed on the inner surface of the retainer 46 on the rear side, to regulate movement of the annular valve body 43 toward the rear side.

The front-side chamber of the annular valve body 43 communicates with the discharge pressure chamber 25, and guides the pump discharge fluid from the discharge pressure chamber 25 to the discharge port 26*a* through the discharge paths 25*a* and 26.

When the pump discharge fluid from the pump chambers 18 flows through the discharge paths 20*a* and 21*a* of the pressure plates 20 and 21 and then flows from the gap 45 to the pump discharge side through the restrictor 50, the annular valve body 43 is moved in the axial direction by the difference between the pressures before and after the restrictor 50.

As shown in FIGS. 1 and 3 and FIGS. 5A to 5C, a plurality of path holes 52 open radially to the outer surface of the cylindrical member 42 that slidably holds the annular valve body 43. The path holes 52 are connected to the pump suction side through the return path including a space 51 between the cylindrical member 42 and driving shaft 16.

When the annular valve body 43 is displaced in the axial direction by the fluid pressure difference of the pump discharge side or the biasing force of the coil spring 44, the pump discharge fluid guided to the gap 45 on the rear side of the annular valve body 43 is returned from the path holes 52 to the pump suction side.

Figure 3:
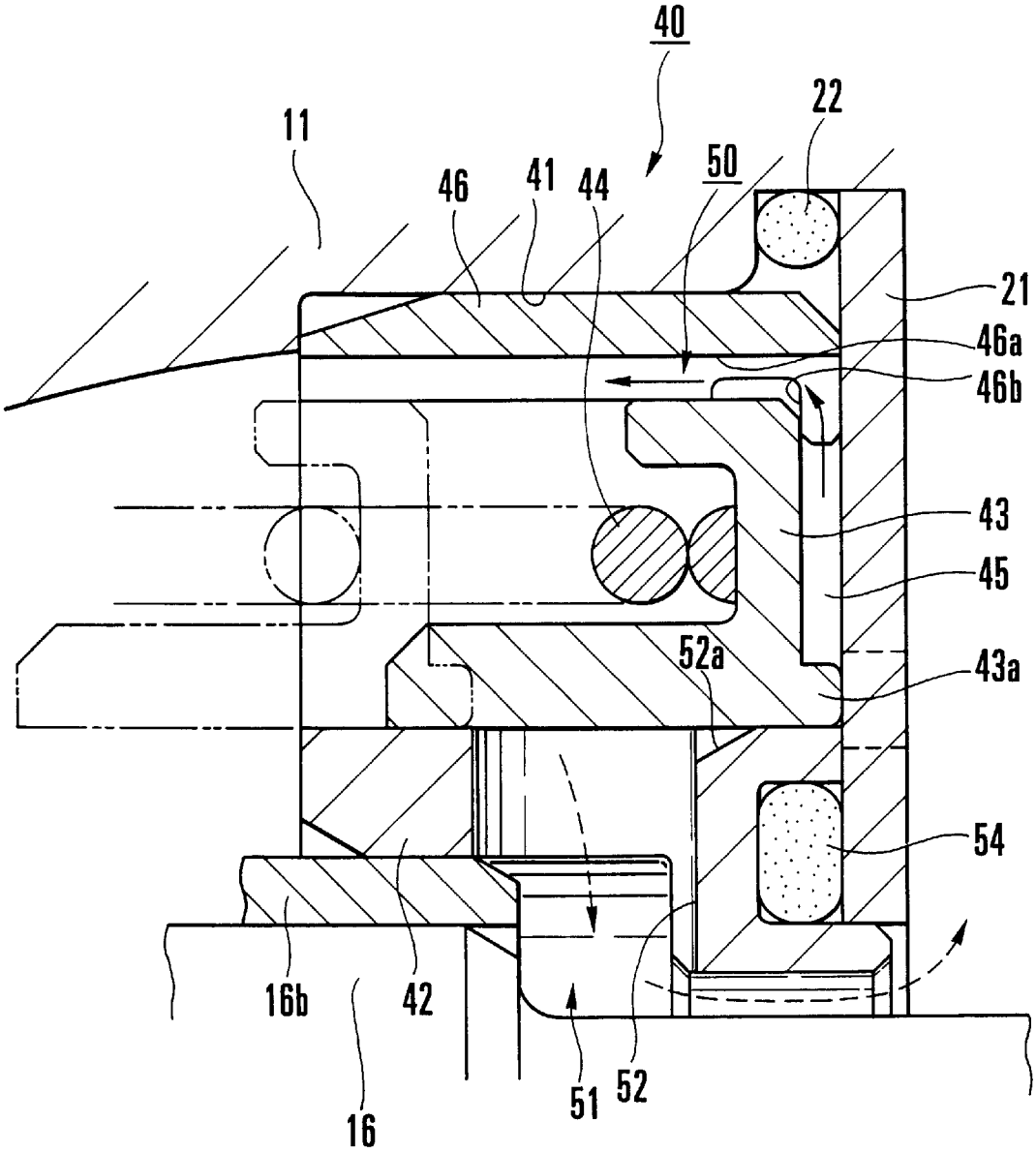
FIG. 3 is an enlarged sectional view of the main part of a portion of the oil pump shown in FIGS. 1 and 2 where a flow control valve as the characteristic feature of the present invention is incorporated.

When the annular valve body 43 described above is displaced in the axial direction, as indicated by solid lines and broken lines in FIG. 3, the opening amount of the path holes 52 changes. The pump discharge fluid is thus returned to the pump suction side in accordance with the opening amount of the path holes 52. In FIG. 3, the annular valve body 43 is moved to such a position that the path holes 52 can be opened. However, the present invention is not limited to this, and the path holes 52 may be opened/closed within the range of an appropriate opening amount.

Figure 5A:
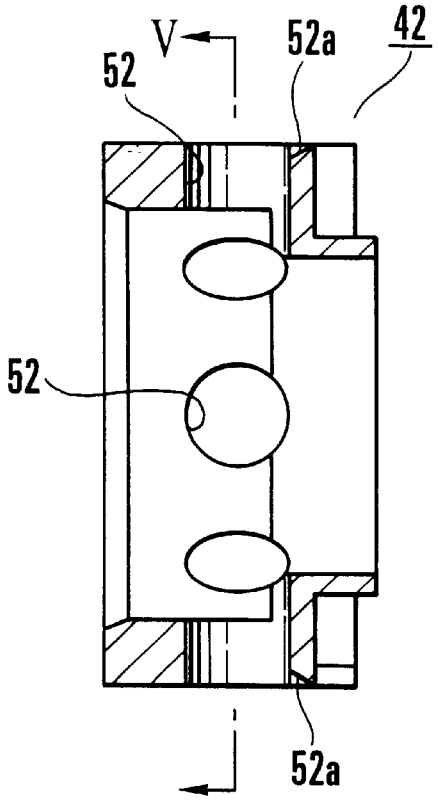
FIG. 5A is a sectional view of a cylindrical member constituting the flow control valve of the oil pump shown in FIGS. 1 to 3.
Figure 5B:
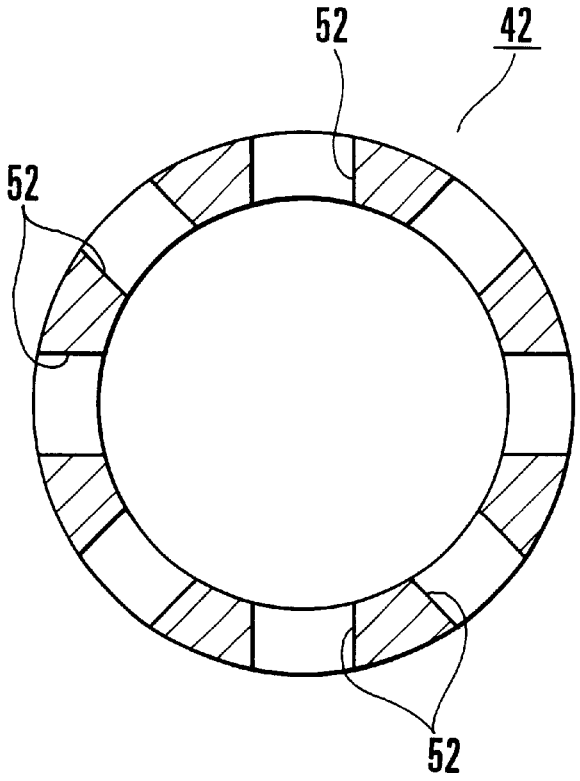
FIG. 5B is a sectional view taken along the line V—V of FIG. 5A.
Figure 5C:
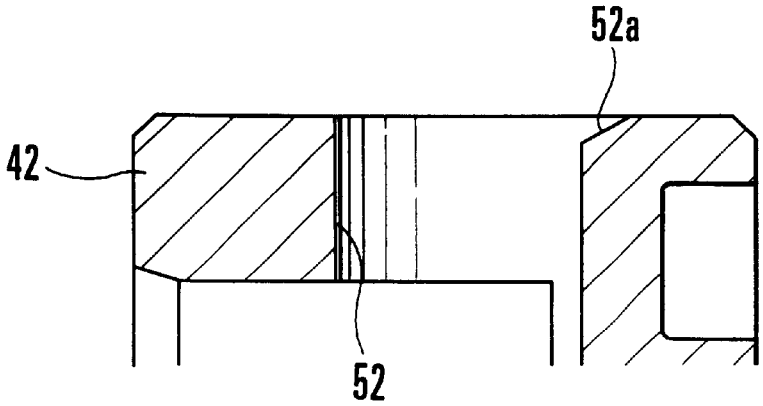
FIG. 5C is an enlarged view of a path hole portion.

A chamfer 52*a* may be formed on the edge, on the rear side, of each path hole 52 to open to each path hole 52, as shown in FIGS. 5A and 5C.

An O-ring 54 is fitted in the end portion on the rear side of the cylindrical member 42 to seal the abutting portion between the cylindrical member 42 and partition plate 21. Hence, the gap 45 and space 51 can be sealed from each other.

A boss 11*c* is formed on the outer side of the bearing 16*b* that holds the driving shaft 16 inside the front body 11. The end face on the front side of the cylindrical member 42 is sealed by a surface seal formed when it comes into surface contact with the end face of the boss 11*c*. The pressure acting on the surface seal portion is lower than the pump discharge fluid pressure acting on the other end face sealed by the O-ring 54 which is on the downstream side of the restrictor 50. Therefore, the cylindrical member 42 can be reliably sealed by the pressure toward the left side in FIG. 1.

In this embodiment, as shown in FIGS. 1 and 2, the return path for connecting the space 51 to the pump suction side is constituted by grooves 56, formed in the side portion on the front side of the pressure plate 20 to bypass the driving shaft 16, and the partition plate 21 that closes the grooves 56.

The grooves 56 constitute a path for guiding the suction fluid from the suction port 28*a* to the pump chambers 18, as shown in FIG. 2. When the grooves 56 communicate with the space 51 around the driving shaft 16, the excessive fluid of the pump discharge fluid can be returned from the pump discharge side to the pump suction side easily.

With the vane pump 10 having the above arrangement, when the rotor 15 is rotatably driven by the driving shaft 16 while projecting and retracting its vanes 15*a*, the hydraulic oil as the working fluid from the suction port 28*a* is taken into the pump chambers 18 through the paths 28, 28*b*, 31, and 32. When the hydraulic oil from the pump chambers 18 has a predetermined pressure or less, it is discharged to the discharge pressure chamber 25 through the discharge paths 20*a* and 21*a* and then the restrictor 50 formed in the flow control valve 40 to serve as the metering orifice. After that, the hydraulic oil is entirely discharged from the discharge port 26*a* (POUT) to a power steering device (the right and left chambers of a power cylinder (not shown)). The hydraulic oil is sent in this manner.

When the hydraulic oil from the pump chambers 18 has a pressure equal to or higher than the predetermined value, it is partly returned to the suction side, while the remaining hydraulic oil flows from the discharge pressure chamber 25 to be discharged from the discharge port 26*a* through the paths 25*a* and 26. More specifically, with the vane pump 10 described above, the annular valve body 43 is axially supported on the cylindrical member 42 fitted on the driving shaft 16 to be movable in the axial direction. The retainer 46 is fitted between the outer surface of the annular valve body 43 opposing the pump chambers 18, and the inner circumferential wall of the annular space 41. The restrictor 50 is formed between the retainer 46 and the outer surface of the annular valve body 43. The fluid discharged from the pump chambers 18 of the pump constituent elements 13 flows through the restrictor 50 to the discharge pressure chamber 25, the discharge paths 25*a* and 26, and to the discharge port 26*a* in the front body 11, to be sent to the power steering device (either the right or left chamber of the power cylinder).

When the rotational speed of the vehicle engine increases to increase the flow rate of the pump discharge fluid, the difference between the pressures before and after the restrictor 50 increases, and the annular valve body 43 moves in accordance with the value of the pressure difference against the biasing force of the spring 44. When the annular valve body 43 moves, the path holes 52 formed in the outer surface of the cylindrical member 42 open. The excessive fluid on the pump discharge side flows to the space 51 between the cylindrical member 42 and driving shaft 16 through the path holes 52, and is returned to the pump suction side of the pump chambers 18 through the suction paths 56 communicating with the space 51.

With this vane pump 10, the flow control valve 40 is placed in the housing space 14 on the front side of the front body 11, to be located in the annular space 41 around the driving shaft 16. When compared to the conventional case wherein the spool is placed in the pump body, close to its outer surface, to be movable in a direction perpendicularly intersecting the axial direction, the entire pump can be made compact.

Since the members constituting the flow control valve 40 are incorporated in the housing space 14 of the pump constituent elements 13 provided to the front body 11, the pump assembly operation becomes simple, as well as the pump can be made compact, so that the manufacturing cost is reduced.

The restrictor 50 is formed in part of the annular valve body 43 constituting the flow control valve 40. When the annular valve body 43 is moved in the axial direction, the pump discharge fluid can be guided from the path holes 52, formed radially in the cylindrical member 42 fitted on the driving shaft 16, to the pump constituent elements 13 through the space 51 formed along the outer surface of the driving shaft 16, and can be returned to the pump suction side through the return path formed of the grooves 56 formed in the pressure plate 20 constituting the pump constituent elements 13. Therefore, the operation efficiency of the pump can be improved. This is due to the following reason. With this structure, the return path which extends from the pump chambers 18 through the discharge paths (20*a* and 21*a*), the gap 45, and the flow control valve 40, and then through the path holes 52, the space 51, and the grooves 56 {particularly the path portions (20*a*, 21*a*, and 45) for returning the return fluid from the pump discharge side through the flow control valve 40} can be made short. A temperature increase caused by the path resistance of the return fluid (excessive fluid) can accordingly be avoided, so that the power loss of the pump can be prevented.

In the arrangement described above, the path 46*a* serving also as the restrictor 50 through which the rear side and front side of the annular valve body 43 communicate with each other is formed between the inner surface of the retainer 46, fitted on the inner circumferential wall of the front body 11, and the outer surface of the annular valve body 43. When the annular valve body 43 is displaced in the axial direction by the difference between the fluid pressures before and after the restrictor 50 and the biasing force of the coil spring 44, the flow control function of the flow control valve 40 can be effected. Also, the restrictor 50 can be formed simply and appropriately.

The return path for guiding the return fluid (excessive fluid) from the flow control valve 40 to the pump suction side of the pump chambers 18 is formed in the form of the grooves 56 in the pressure plate 20 constituting the pump constituent elements 13. The return path can thus be formed with a necessary minimum length. This short path reduces the fluid resistance and accordingly the pressure loss. Therefore, the wasteful power loss can be smaller than in the conventional case. The operation efficiency of the pump is accordingly improved. In addition, the return path described above has a simple structure and can be formed easily.

Since the flow of the excessive fluid can be formed with a short path, an increase in fluid temperature (oil temperature) can be reduced, so that an expensive heat-resistant seal component becomes unnecessary.

In particular, in this embodiment, the return path for guiding the return side fluid (excessive fluid) from the flow control valve 40 to the pump suction side is constituted by the grooves 56, formed in the side portion of the pressure plate 20 on the partition plate 21 side, and the partition plate 21 that closes the grooves 56. Therefore, the structure is simplified, and the respective portions can be formed and assembled easily.

FIGS. 6 to 11B show a vane pump to which an oil pump according to another embodiment of the present invention is applied. Referring to FIGS. 6 to 11B, portions identical or corresponding to their counterparts in the embodiment shown in FIGS. 1 to 5C are denoted by the same reference numerals, and a detailed description thereof will be omitted.

One of the differences between this embodiment and that described above resides in the structure of a flow control valve 40 provided to the pump discharge side. More specifically, in this embodiment, a portion constituting the flow control valve 40 is formed as follows.

This will be described in detail. In the discharge flow channel, each recessed groove 60 that forms a restrictor 50 for actuating the flow control valve 40 is directly formed in the inner wall portion forming an annular space 41 of a front body 11, as shown in FIGS. 6 and 9, FIGS. 10A to 10C, and FIGS. 11A and 11B. The retainer 46 used in the above embodiment is omitted.

With this arrangement, the number of components constituting the flow control valve 40 can be reduced, and the grooves 60 can be formed easily in the front body 11 by cored holes. As a result, the manufacturing cost is reduced, while the machinability and assembly easiness are improved.

FIGS. 11A and 11B show the shape of the groove 60, forming the restrictor 50 described above, in the axial direction. In FIG. 11A, a groove 60 for forming a restrictor 50 is formed to have a predetermined width in the axial direction of an annular space 41 which holds an annular valve body 43 of a front body 11. With this shape, flow control can be performed with a constant flow rate, so that the discharge flow rate from the pump can be controlled always to a constant flow rate.

In FIG. 11B, a groove 60 for forming a restrictor 50 is formed such that its width gradually changes in accordance with the motion of an annular valve body 43. With this shape, the discharge flow rate from the pump can be controlled with so-called drooping characteristics which can decrease the discharge flow rate from the pump to be lower than the maximum flow rate in accordance with an increase in rotational speed of the pump.

Figure 9:
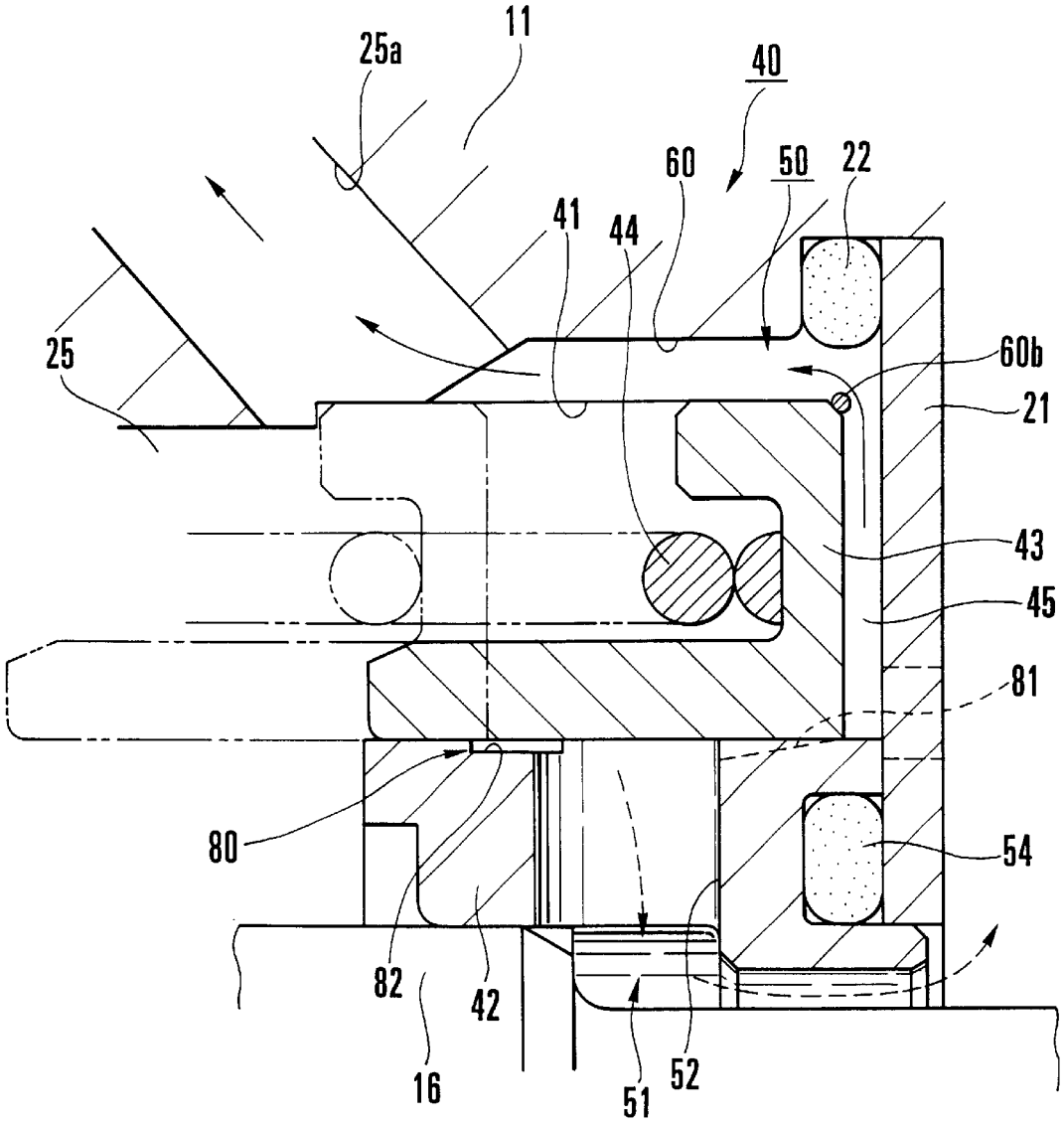
FIG. 9 is an enlarged sectional view of the main part of a portion of the oil pump shown in FIGS. 6 to 8 where a flow control valve is incorporated.
Figure 12:
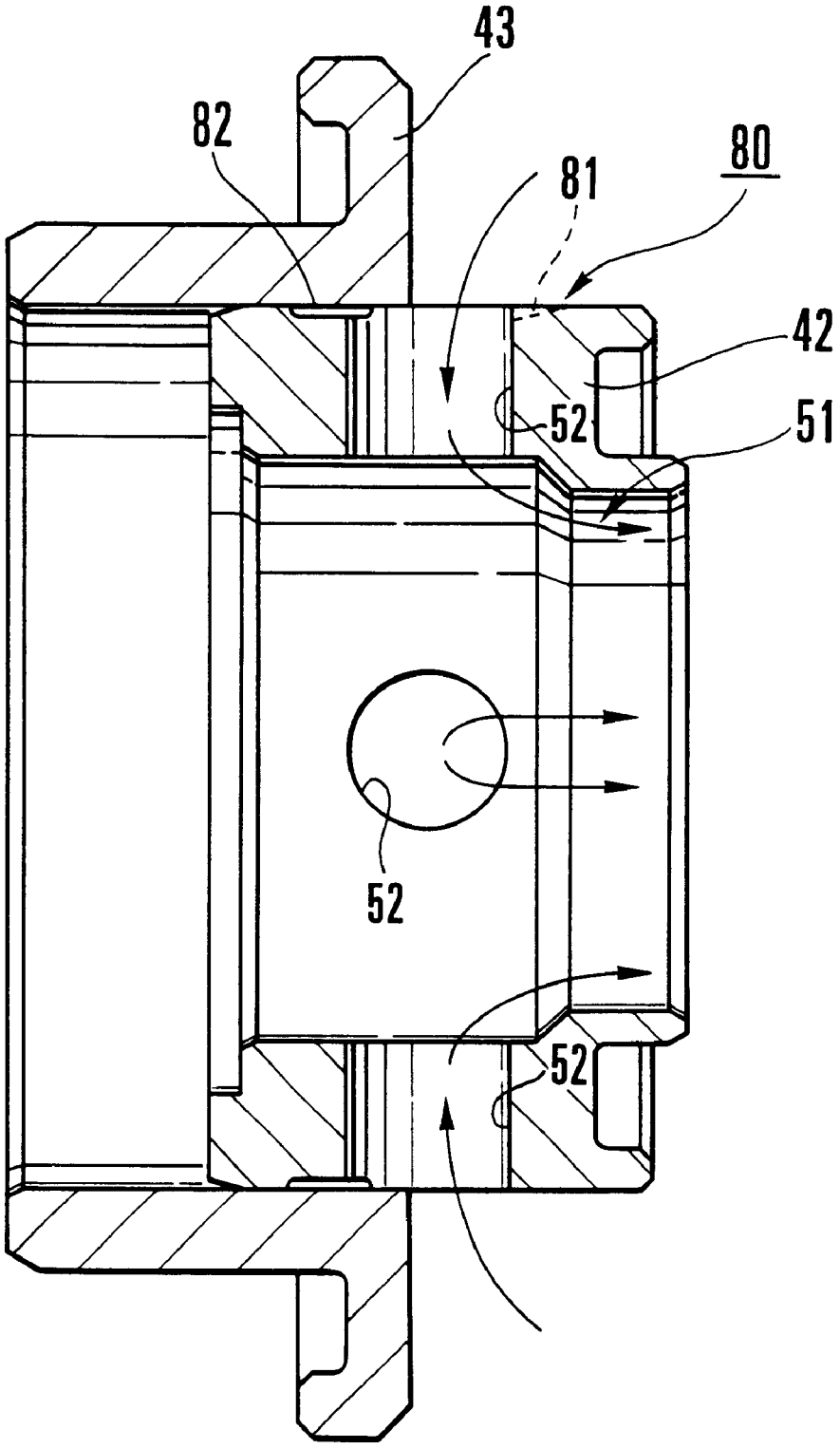
FIG. 12 is a side sectional view showing the relationship between a cylindrical member and annular valve body constituting the flow control valve of FIG. 9.
Figure 13B:
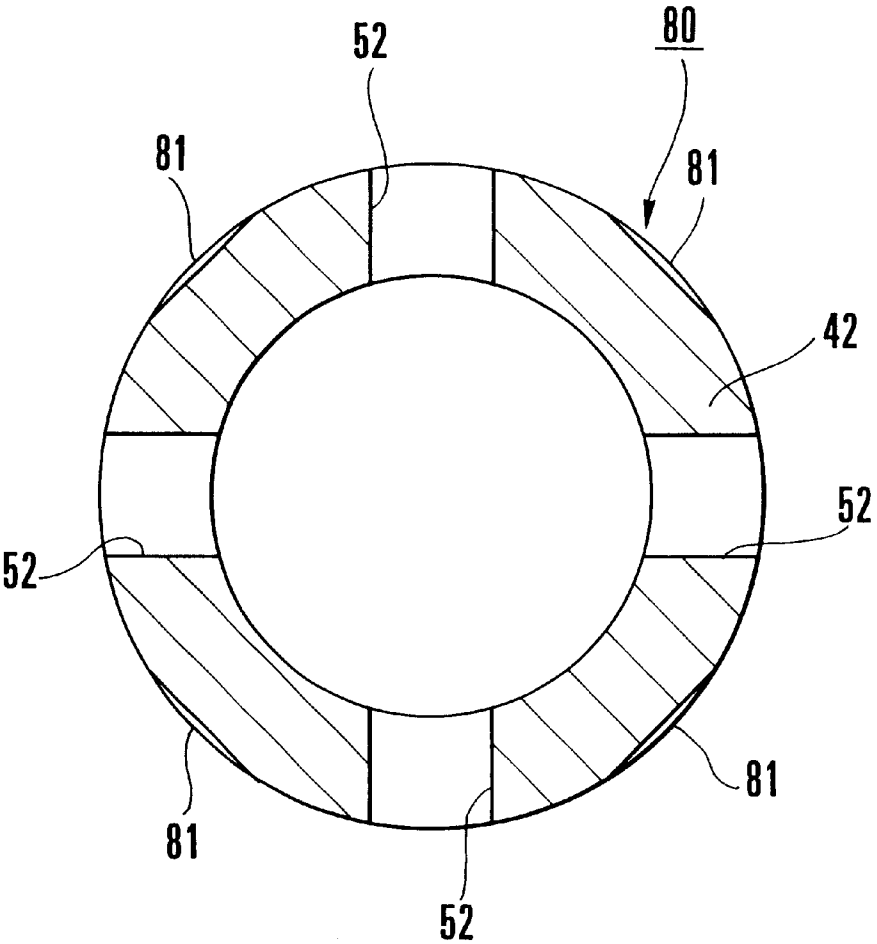
Figure 13A:
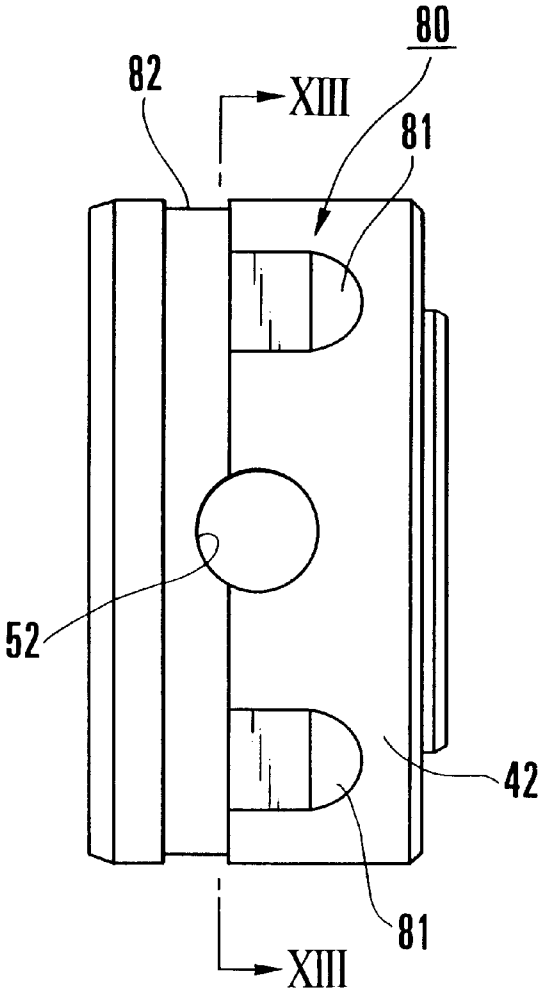
Figure 14C:
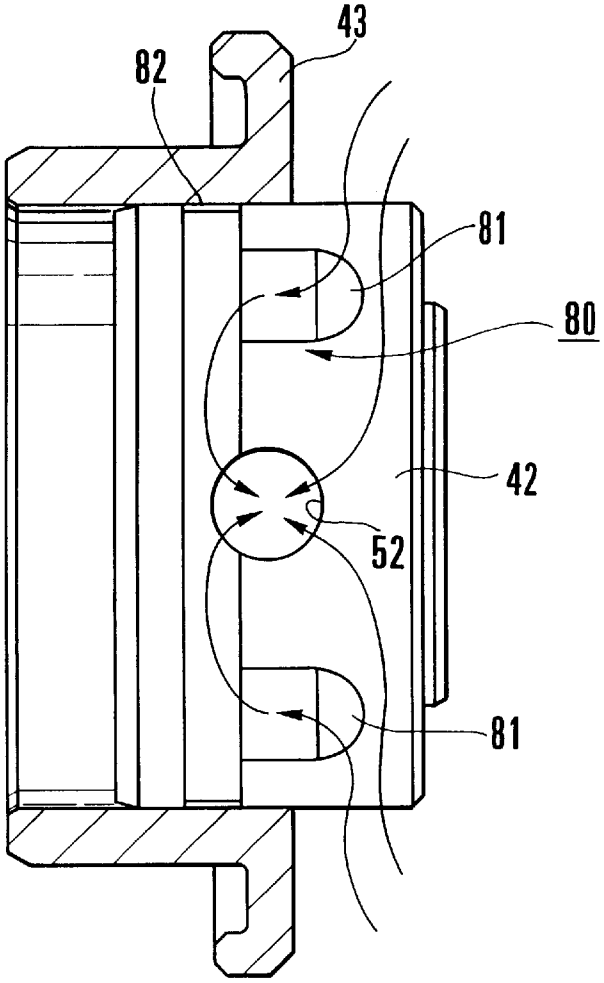
FIGS. 14A, 14B, and 14C are views for explaining motion of the annular valve body on the outer surface of the cylindrical member and a resultant communicating state of the communication path for the excessive fluid.
Figure 14B:
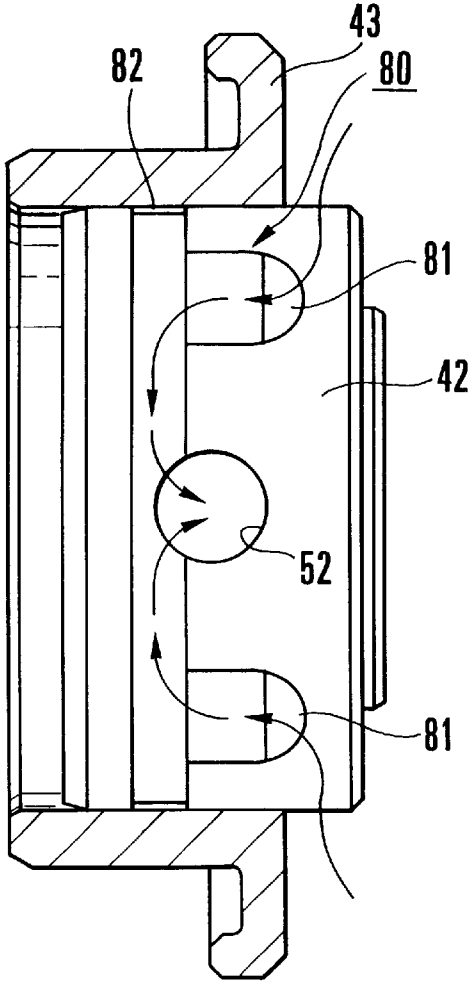
Figure 14A:
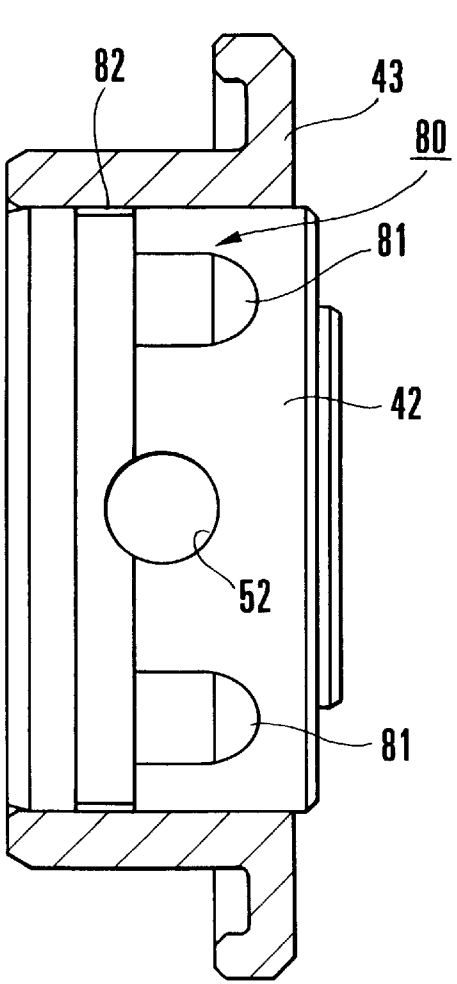

In FIG. 9, a set ring 60*b* is placed in the annular space 41 on the rear side of the inner wall. The set ring 60*b* regulates movement of the annular valve body 43 toward the rear side. At this regulating position, the set ring 60*b* defines a gap 45, on the rear side of the annular valve body 43, together with a partition plate 21. The pump discharge fluid is introduced into the gap 45.

In this embodiment, unlike in the above embodiment, since the set ring 60*b* regulates the annular valve body 43, a regulating projection 27 is omitted, and the shape of the annular valve body 43 is simplified, thus facilitating the manufacture.

When the fluid flows from pump chambers 18 to paths 20*a* and 21*a* of the pressure plate 20 and a partition plate 21 and then from the gap 45 to the pump discharge side through the restrictor 50, the annular valve body 43 is moved in the axial direction by the difference between the pressures before and after the restrictor 50.

Regarding the shape of path holes 52 of a cylindrical member 42 opened/closed by the annular valve body 43 constituting the flow control valve 40, and the structure of a portion around the path holes 52, as shown in FIG. 9 and FIGS. 12 to 15, the path holes 52 may be formed such that their area does not change sharply when the flow control valve 40 is opened/closed by the annular valve body 43.

More specifically, in the embodiment described above, the annular valve body 43 constituting the flow control valve 40 slides on the cylindrical member 42 in accordance with the difference between the pressures before and after the restrictor 50, to gradually open the path holes 52, so that the excessive fluid is returned to the pump suction side. In this structure. the chamfer 52*a* is formed on the side edge of each path hole 52 to suppress the high-pressure pump discharge fluid from abruptly communicating with the pump suction side.

The chamfer 52*a* is formed toward the side edge of each path hole 52, to cause the pump discharge side to communicate with the corresponding path hole 52 along with movement of the annular valve body 43. Depending on the value of the pump discharge fluid pressure, the chamfer 52*a* tends to cause a sharp pressure decrease when the fluid flows to the pump suction side. When this sharp pressure decrease is large, a so-called jet is formed to flow to the pump suction side. Air bubbles are then formed to cause cavitation, generating noise.

In contrast to this, in this embodiment, an excessive fluid communication path 80 is formed through which the pump suction side communicates with the path holes 52 in accordance with the movement of the annular valve body 43, so that the excessive fluid flows from the pump discharge side to the pump suction side gradually, when the flow control valve 40 is opened/closed, in accordance with a moderate pressure change. The communication path 80 is formed such that its sectional area changes moderately while its length is formed as large as possible. In other words, the communication path 80 is formed to have a gradually increasing sectional area, in order to guide the pump discharge fluid to the path holes 52 such that the fluid pressure does not decrease abruptly.

This will be described in detail. As shown in FIGS. 12 to 14C, the four path holes 52 are formed at portions to open radially to the outer surface of the cylindrical member 42 constituting the flow control valve 40. The path holes 52 are normally closed with the annular valve body 43. Four chamfers 81 serving as axial paths are formed at positions shifted from the path holes 52 of the cylindrical member 42 in the circumferential direction. The chamfers 81 extend from positions, which are opened when the annular valve body 43 moves in the opening direction rather than the path holes 52 are, to positions past the path holes 52.

Furthermore, an annular groove 82 is formed as a circumferential path in the outer surface of the cylindrical member 42 to cause the chamfers 81 and path holes 52 to communicate with each other in the side end portion, in the opening direction, of the annular valve body 43.

With this arrangement, as shown in FIGS. 14A, 14B, and 14C and FIG. 15, when the annular valve body 43 moves in the opening direction, the pump discharge side first communicates with the path holes 52, via the chamfers 81, through the annular groove 82, to form the excessive fluid communication path 80. Since the communication paths to the path holes 52 are formed via the lengths of the respective chamfers 81 and the circumferential length of the annular groove 82, the path length can be assured while maintaining a small sectional area of the path.

Therefore, when communicating with the return side, a sharp temperature decrease does not occur, cavitation can be prevented, and noise can be suppressed, thereby greatly improving the operation efficiency of the pump.

Figures 15A, 15B:
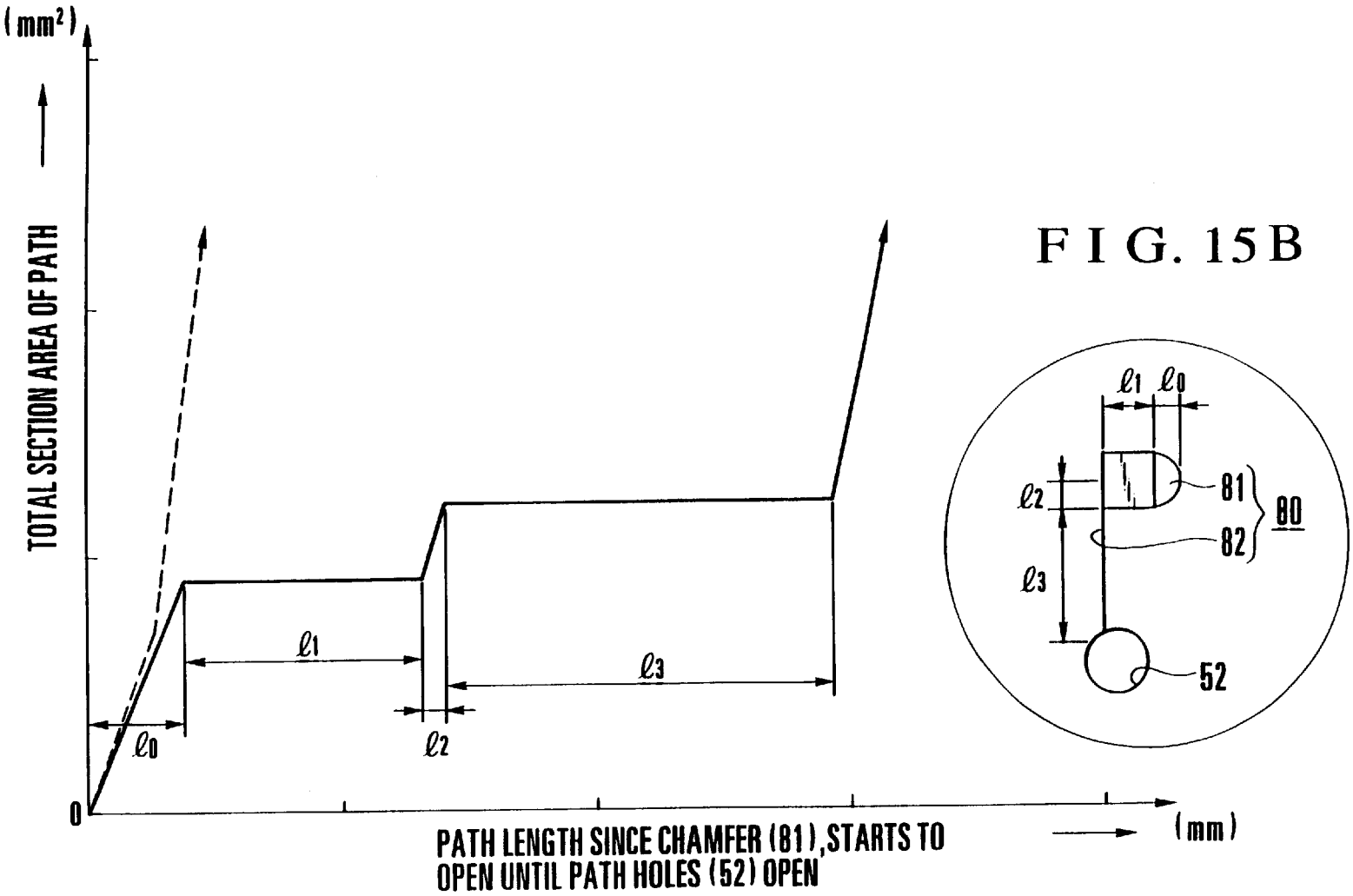
FIG. 15 is a graph for explaining the relationship of the total sectional area of the communication path with respect to the path length of the communication path for the excessive fluid obtained by the flow control valve shown in FIGS. 12 to 14C.

When the annular valve body 43 further moves in the opening direction to start opening the path holes 52, the excessive fluid from the pump discharge side flows via the direct flow channel to the path holes 52, and via the flow channel that extends through the chamfers 81 and the annular groove 82 described above. When the path holes 52 are opened, the excessive fluid flows to the return-side flow channel in accordance with the opening amount of the path holes 52. FIG. 15 shows the relationship between the path length and sectional area of the communication path 80. Characteristics different from those of a normal type indicated by a broken line are obtained.

According to this embodiment, the communication path 80 for returning the excessive fluid to the pump suction side through the flow control valve 40 is formed as long as possible to moderate the pressure decrease of the return fluid. As a result, cavitation on the return path is prevented to suppress noise.

In this embodiment, as shown in FIGS. 6 to 9, openings 56*a* for introducing the excessive fluid described above are formed in the pump chambers 18 on the pressure plate 20 side. Openings 31*a* and 32*a* of suction paths 31 and 32 for guiding the suction fluid from a tank T are formed in a rear body 12.

With this arrangement, the paths 31 and 32, and paths 56 for guiding the suction fluid from the tank T and the excessive fluid from the flow control valve 40 to the suction side of the pump chambers 18 can be separated. The suction fluid and excessive fluid are separately taken into the corresponding pump chambers 18 through the suction openings 31*a* and 32*a*, and the excessive fluid introducing openings 56*a* formed in the rear body 12 and pressure plate 20 respectively arranged on the two sides of a rotor 15 and a cam ring 17 that form the pump chambers 18.

Therefore, unlike in the embodiment described above, the suction fluid and the excessive fluid do not merge before being taken into the pump chambers 18. Cavitation caused by collision of the suction fluid and excessive fluid in the suction path 28 and suction path 31 and 32 can be prevented. Even when the rotational speed of the pump increases to increase the flow rate of the excessive fluid, cavitation and resultant noise can be prevented.

This will be described in detail. In the oil pump 10 of the embodiment shown in FIGS. 1 to 5C described above, the structure for incorporating the flow control valve 40 into the pump body (11, 12) is improved to make the entire pump compact. The structure of the flow control valve 40, including the return path composed of the communication path 80, the path holes 52, the grooves 56, and the like, for returning the excessive fluid from the pump discharge side to the suction side is improved to reduce the manufacturing cost of the entire pump. Also, the structure of the return path is simplified and shortened to decrease wasteful power loss. In returning the excessive fluid to the suction side with the flow control valve 40, however, the excessive fluid is merged with the suction fluid from the tank midway along the suction path that introduces the suction fluid to the suction side of the pump chambers, and is introduced to the suction side of the pump chambers. This structure may accordingly pose the following problems.

More specifically, since the excessive fluid at the flow control valve described above is a return fluid from the discharge side, it has a pressure. When the excessive fluid is returned to the suction path from the tank, it forms a jet to merge with the suction fluid. The resultant flow is taken into the suction side of the pump chambers.

In this path structure, when the rotational speed of the pump is low, since the excessive fluid has a small flow rate and a low flow velocity, it merges with the suction fluid from the tank and is taken into the suction side of the pump chambers. At this time, the in-flow movement of the suction fluid and excessive fluid to the suction side of the pump chambers is not interfered with.

In contrast to this, when the rotational speed of the pump increases to reach a high rotational speed, the flow rate of the excessive fluid from the pump discharge side increases in proportion to the rotational speed. The flow velocity increases also, so that the flow of the suction fluid from the tank is interfered with by the jet of the excessive fluid at the merge portion. As a result, the suction flow rate to the suction side of the pump chambers becomes insufficient. A negative pressure region is formed to cause cavitation, thus generating noise.

In this embodiment, in order to prevent this inconvenience, the combination structure of the pressure plate 20 and partition plate 21 for forming the return path, which is comprised of the communication path 80, the grooves 56, and the like to return the excessive fluid from the flow control valve 40 to the pump suction side, is improved.

In this embodiment, positioning projections 61 position the pressure plate 20 and partition plate 21, thereby aligning the discharge paths 20*a* and 21*a* with each other. As shown in FIG. 16 and FIGS. 17A to 17C, the positioning projections 61 are formed by partly bending the partition plate 21.

Figure 6:
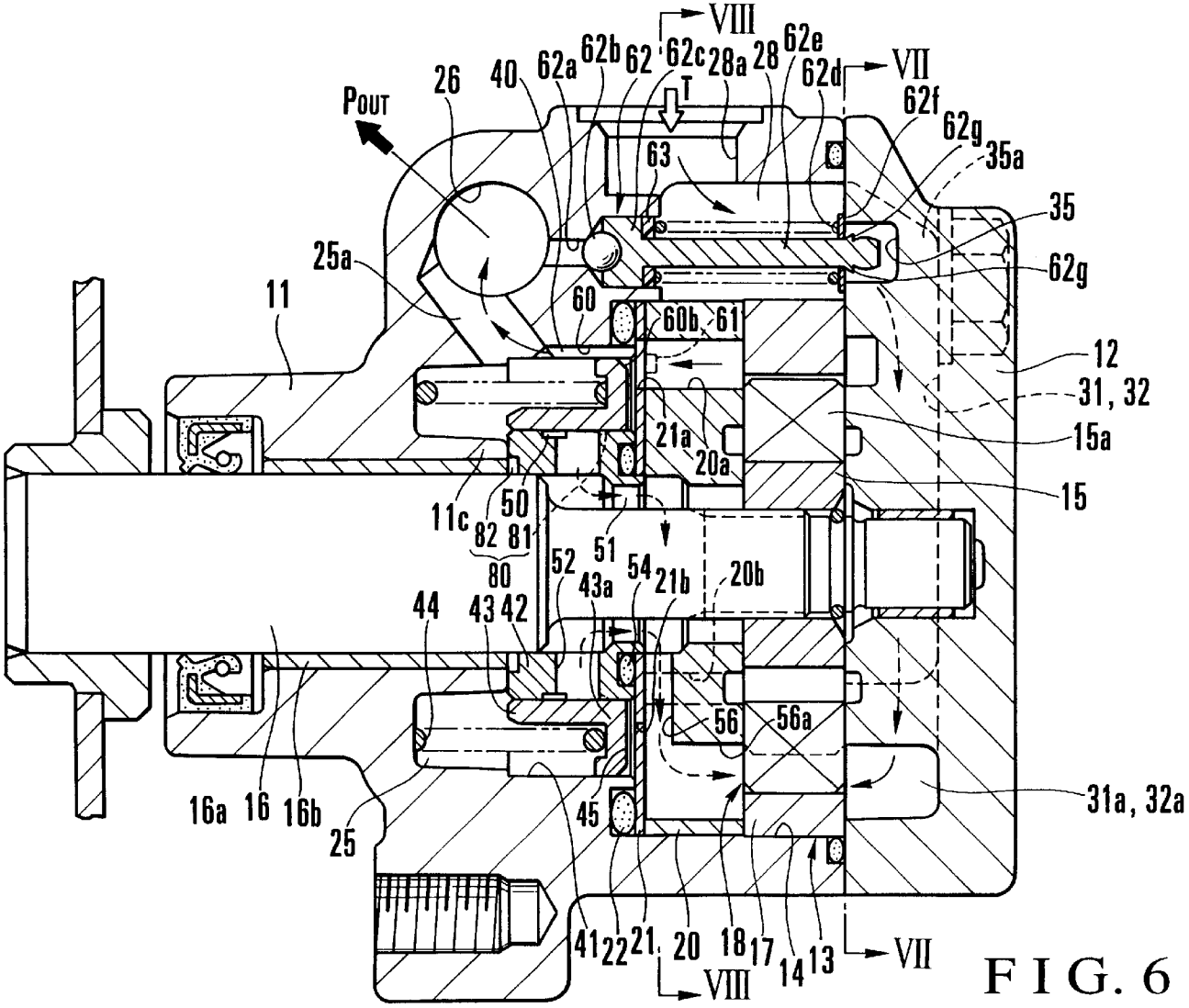
FIG. 6 is a longitudinal sectional view of the entire portion of an oil pump according to another embodiment of the present invention.
Figure 16:
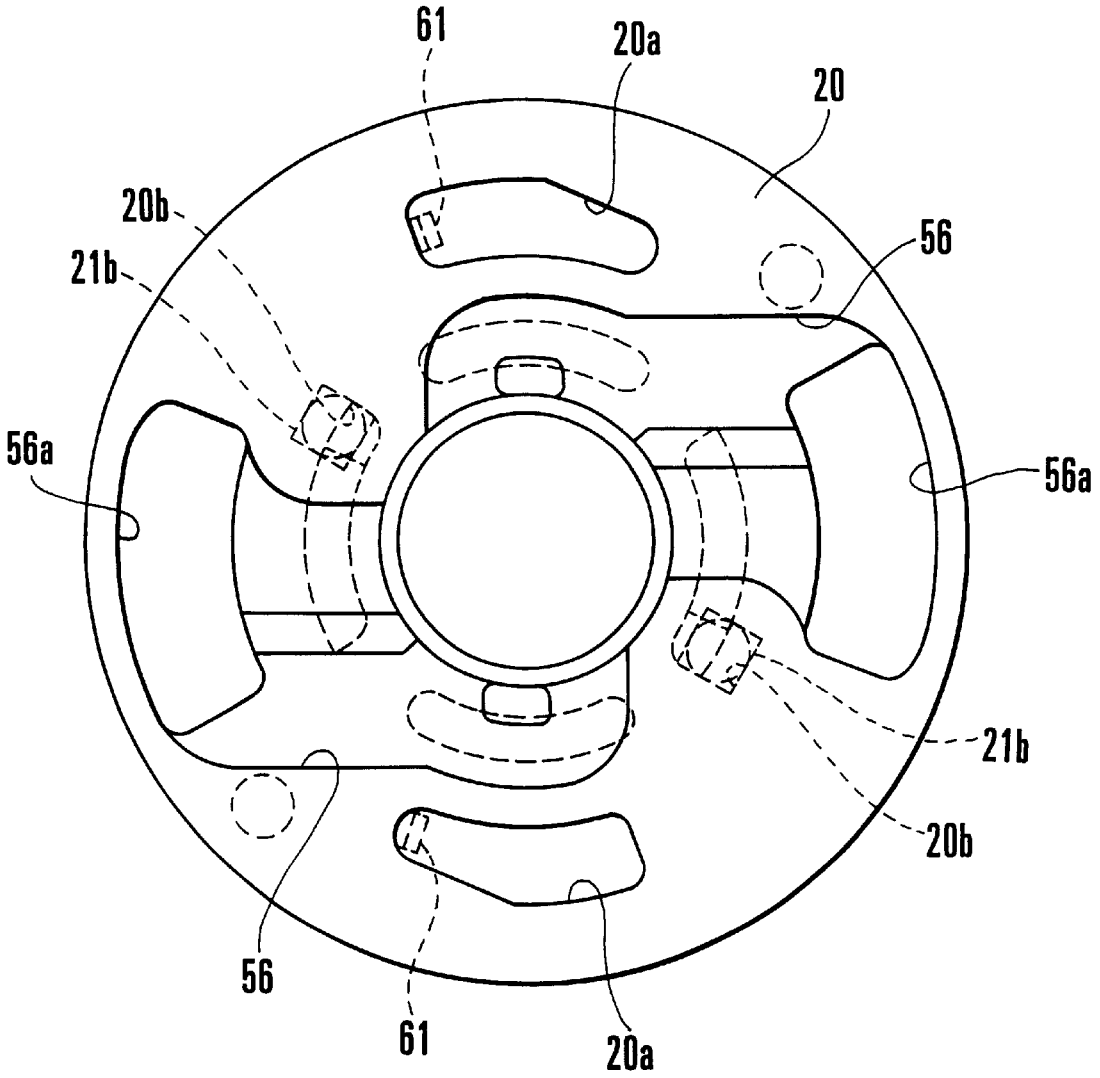
FIG. 16 is an end face view of a pressure plate, on a side opposite to the pump chamber, of the oil pump shown in FIGS. 6 to 8 which is the characteristic feature of the present invention.
Figure 17A:
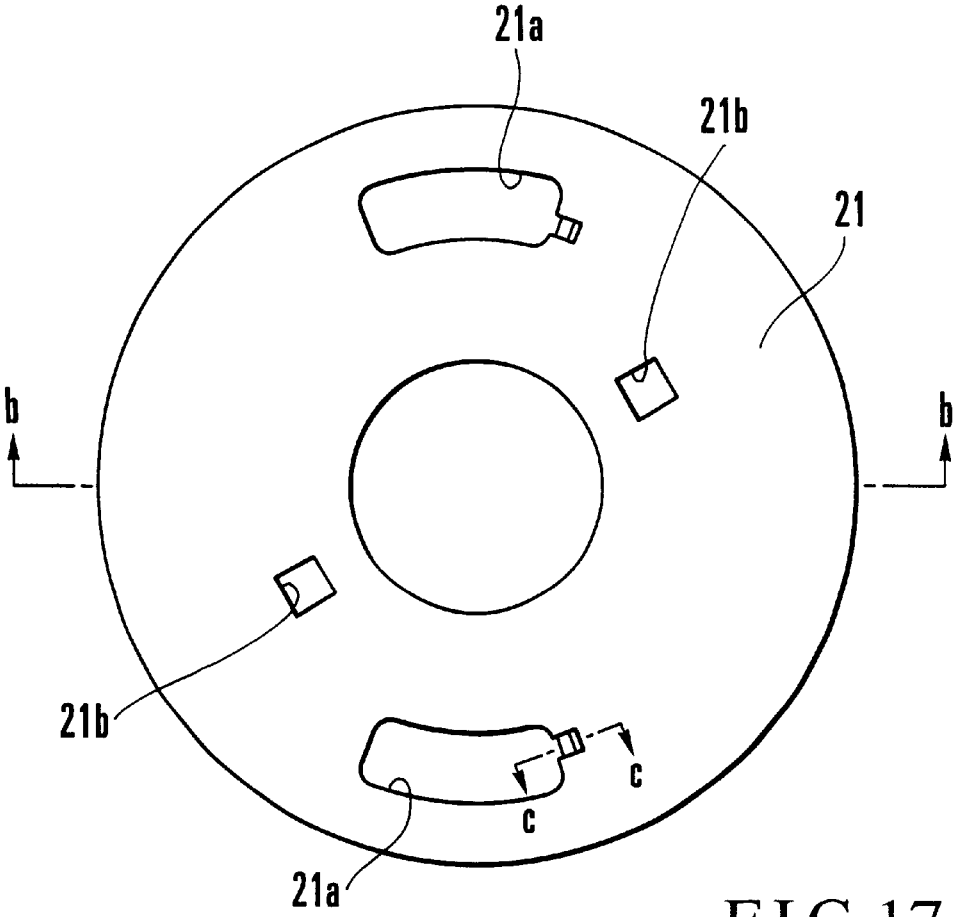
Figure 17B:
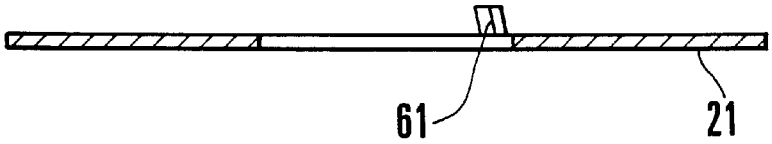
Figure 17C:
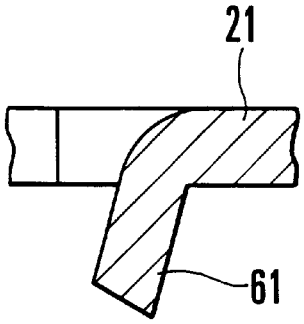

As shown in FIG. 16 and FIGS. 17A to 17C, the positioning projections 61 are locked by the side edges of discharge paths 20*a* of the pressure plate 20, thereby positioning the plates 20 and 21. In FIG. 17A, holes 21*b* open to part (45) of the discharge paths. As shown in FIGS. 6 and 16, the holes 21*b* guide the discharge fluid to the proximal end portions of vanes 15*a* of the rotor 15 through path holes 20*b* formed in the pressure plate 20.

Figure 7:
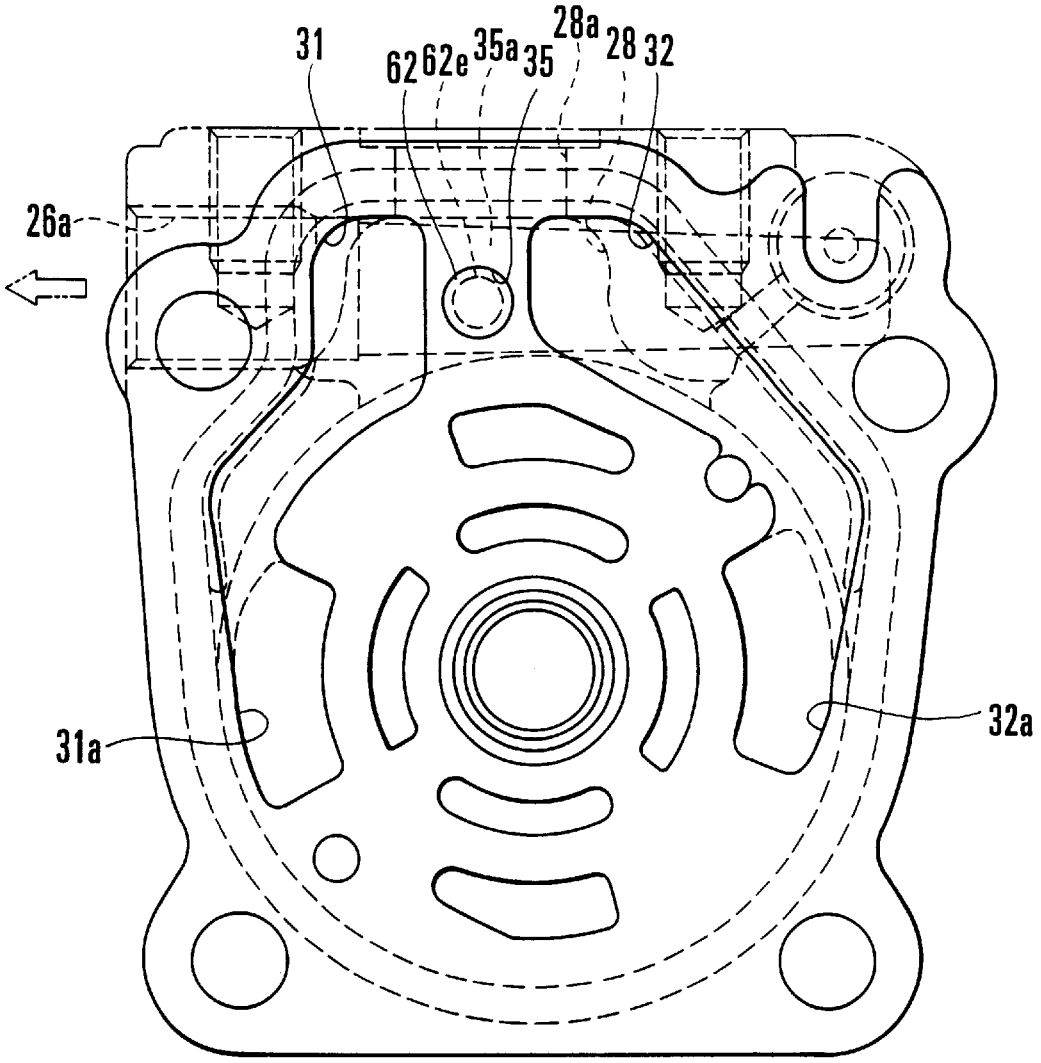
FIG. 7 is an end face view of a rear body taken along the line VII—VII of FIG. 6 in which the main part of the front body is indicated by broken lines.
Figure 8:
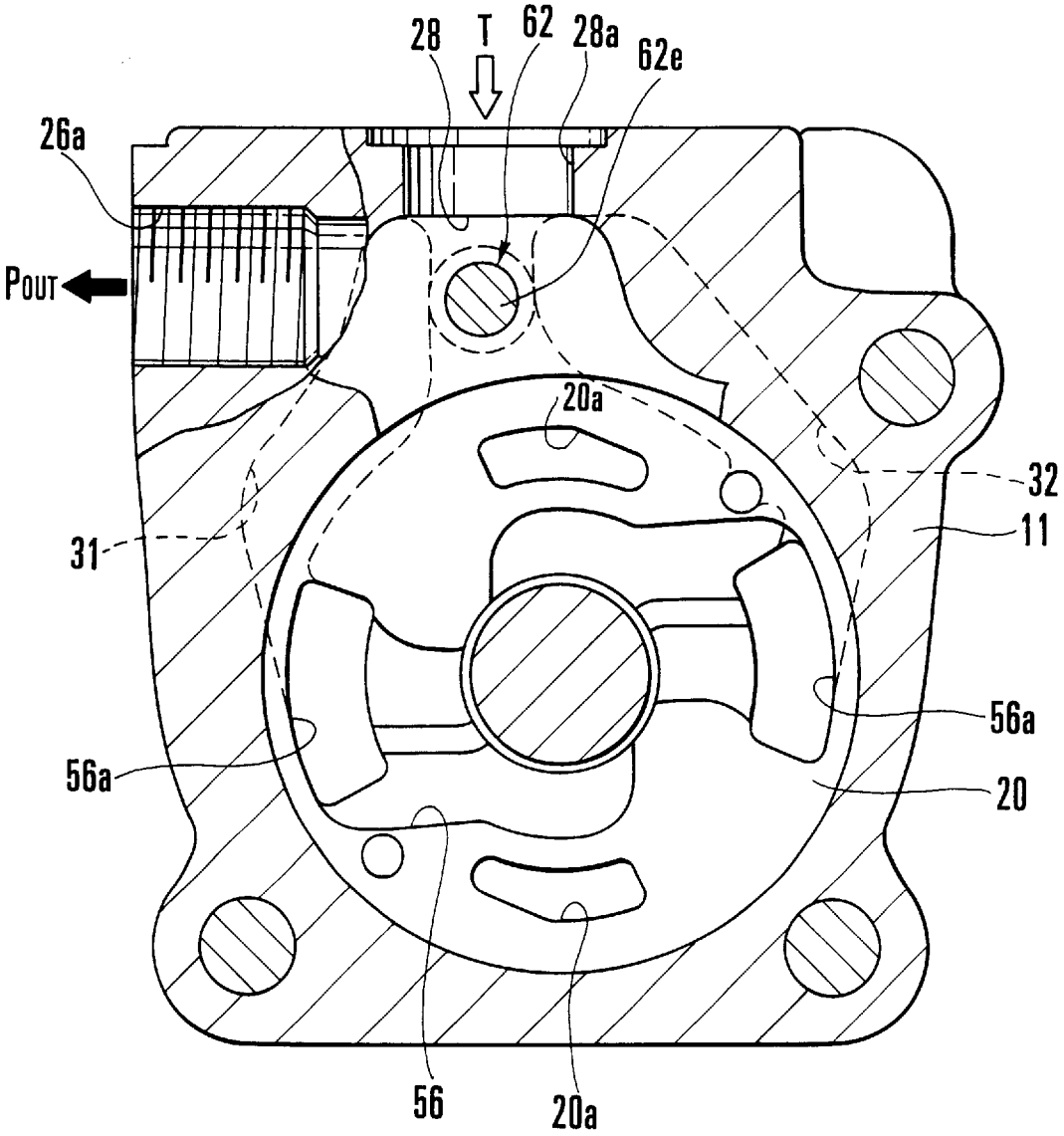
FIG. 8 is a sectional view taken along the line VIII—VIII of FIG. 6.

As shown in FIGS. 6 and 7, a suction path 28 opens to the end face of the pressure plate 20, and is connected to the suction paths 31 and 32 formed in the rear body 12 in the form of a two-forked path. The suction path 28 is formed in the front body 11 by a cored hole. As shown in FIGS. 6 and 7, the suction paths 31 and 32 are formed by forming recesses in the end face, on the front body 11 side, of the rear body 12. The suction paths 31 and 32 formed of the recesses are closed with the front body 11, the cam ring 17, the rotor 15, and the like except for necessary portions, to serve as paths for flowing the suction fluid.

As shown in FIG. 7, the suction paths 31 and 32 are formed, in the end face of the rear body 12, to extend from their proximal end portions, communicating with the suction path 28 on the front body 11 side, to the suction openings 31*a* and 32*a*, that open to the suction side of the pump chambers 18, in the form of the two-forked path. The suction paths 31 and 32 are almost closed by the end face of the front body 11 and the side surface of the cam ring 17, so that only their proximal end portions described above and the openings 31*a* and 32*a* are opened. Therefore, with the suction paths 31 and 32, the suction fluid (working fluid) from the tank T can be guided to the respective suction regions of the two pump chambers 18.

Furthermore, in this embodiment, a relief vale 62 in FIG. 6 is formed in the following manner. The relief vale 62 is interposed between the suction path 28 and discharge path 26, as described above, and is actuated when the fluid pressure in the discharge path 26 reaches a predetermined value or more. In this embodiment, the relief vale 62 has the following arrangement. More specifically, the relief vale 62 is constituted by a ball 62*b*, a ball retainer 62*c*, and a compression coil spring 62*d*. The ball 62*b* opens/closes a relief hole 62*a* through which the two paths 28 and 26 communicate with each other. The ball retainer 62*c* holds the ball 62*b*. The compression coil spring 62*d* applies a predetermined preset pressure to the ball retainer 62*c*.

Figure 19A:
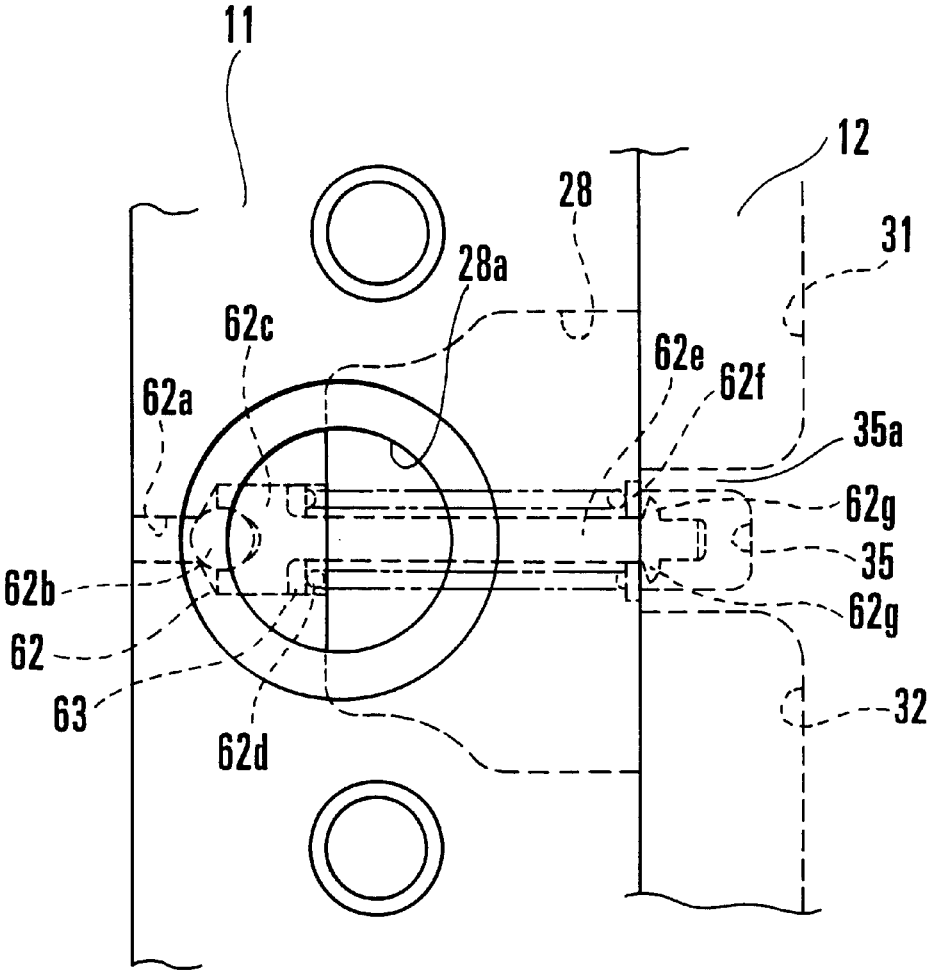
FIG. 19A is a plan view for explaining a relief valve portion of the oil pump shown in FIG. 6.
Figure 19B:
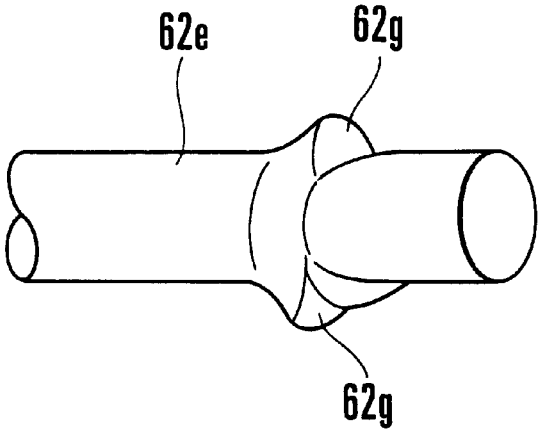
FIG. 19B is a schematic view showing the outer end portion of the shaft of a ball retainer.

In this embodiment, as shown in FIG. 6 and FIGS. 19A and 19B, the compression coil spring 62*d* is fitted on part of a shaft 62*e* extending to a side of the ball retainer 62*c* opposite to the ball receiving surface, and after that, a spring retainer 62*f* is fitted on the shaft 62*e*. A locking projection 62*g* is formed, by notching using a blocking cutter or by caulking, on a portion of the shaft 62*e* on the outer end side of the spring retainer 62*f*.

With this structure, the compression coil spring 62*d* and spring retainer 62*f* are fitted on the shaft 62*e* of the ball retainer 62*c* constituting the relief vale 62, and are integrated with each other by the locking projection 62*g* formed by the blocking cutter. Unlike in the conventional pump, the relief vale 62 need not be incorporated in the pump body while compressing the compression coil spring 62*d*. The incorporating operation can thus be performed very easily.

In other words, the integrated unit described above can be incorporated in the front body 11 together with the ball 62*b*, and the rear body 12 is built on it, so that the two bodies 11 and 12 can be integrally connected to each other very easily.

In the conventional vane pump, for example, the relief path for connecting the discharge path and suction path formed in the pump body are formed across the two bodies of the pump body. The ball, the ball retainer, the compression coil spring, and the like constituting the relief valve are incorporated in the relief path by fitting. In this conventional incorporating structure, to assemble the pump body, after the compression coil spring is compressed, it must be incorporated in one body, and locked with the other body. The assembling operation is thus very difficult.

With the arrangement of this embodiment, the operation of incorporating the respective members constituting the relief vale 62 into the pump body can be simplified.

In FIGS. 6, 7, and 8, and FIGS. 19A and 19B, the outer end of the shaft 62*e* of the ball retainer 62*c* described above faces a recess hole 35. The recess hole 35 is formed in a partition step 35*a* between the introducing portions of the suction paths 31 and 32 described above. The shaft 62*e* of the ball retainer 62*c* also has a function of positioning the front body 11 and rear body 12 in the rotational direction.

The partition step 35*a* serves as a rib for partitioning the suction paths 31 and 32, recessedly formed in the end face of the rear body 12, from each other, and the recess hole 35 for housing the shaft 62*e* of the ball retainer 62*c* is formed in its end face. The partition step 35*a* has a function of stopping radial wobbling of the shaft 62*e* housed in the recess hole 35. The peripheral edge portion of the recess hole 35 forms the surface of the spring retainer 62*f*, e.g., a washer, which locks the compression coil spring 62*d* of the relief vale 62.

When the spring retainer 62*f* is locked by the retainer surface formed on the end face of the rear body 12, the compression length of the compression coil spring 62*d* fitted on the shaft 62*e* of the ball retainer 62*c* can be set constant, so that the spring force generated by the compression coil spring 62*d* can be regulated substantially constant.

An annular vibration damping member 63 shown in FIGS. 6 and 19A is made of an elastic material such as a synthetic resin material or rubber, and is held by the proximal end portion of the shaft 62*e* of the ball retainer 62*c* constituting the relief vale 62. When the vibration damping member 63 is held by the shaft 62*e* so that it is present at the receiving member of the compression coil spring 62*d*, it slows down the movement of the ball 62*b*, ball retainer 62*c*, and compression coil spring 62*d* which operate when the relief vale 62 performs a relief operation. As a result, the vibration of the ball 62*b*, ball retainer 62*c*, and compression coil spring 62*d* is suppressed to decrease vibration noise generated when metal members collide against each other.

The vibration damping member 63 may be one entirely formed of a continuous annular member, or one partly having a slit to form a substantially C-shape side. If a slit is formed in this manner, when the vibration damping member 63 is urged by the compression coil spring 62*d*, it is extended outwardly in the radial direction to come into contact with an inner wall portion that holds the ball retainer 62*c*, and suppresses vibration of the shaft 62*e* with slide contact generated by this contact more effectively.

With a vane pump 10 having the above arrangement as well, when the rotor 15 is rotatably driven by a driving shaft 16 while projecting and retracting its vanes 15*a*, the hydraulic oil as the working fluid from a suction port 28*a* is taken into the pump chambers 18 through the paths 28, 31, and 32. When the hydraulic oil from the pump chambers 18 has a predetermined pressure or less, it is discharged to a discharge pressure chamber 25 through the discharge paths 20*a* and 21*a* and then the restrictor 50 formed in the flow control valve 40 to serve as the metering orifice. After that, the hydraulic oil is entirely discharged from a discharge port 26*a* (POUT) to a power steering device (the right and left chambers of a power cylinder (not shown)). The hydraulic oil is sent in this manner. FIG. 6 shows this state.

When the hydraulic oil from the pump chambers 18 has a pressure exceeding the predetermined value, it is partly returned to the suction side by the flow control valve 40, while the remaining hydraulic oil flows from the discharge pressure chamber 25 to be discharged from the discharge port 26*a* through paths 25*a* and 26. More specifically, with the vane pump 10 described above, the annular valve body 43 is axially supported on the cylindrical member 42 fitted on the driving shaft 16 to be movable in the axial direction.

A groove 60 is formed in the outer surface of the annular valve body 43 opposing the pump chambers 18, and the inner circumferential wall of the annular space 41. The restrictor 50 is formed between the groove 60 and the outer surface of the annular valve body 43. The fluid discharged from the pump chambers 18 of the pump constituent elements 13 flows through the restrictor 50 to the discharge pressure chamber 25, the discharge paths 25*a* and 26, and to the discharge port 26*a* in the front body 11, to be sent to the power steering device (either the right or left chamber of the power cylinder).

Figure 18:
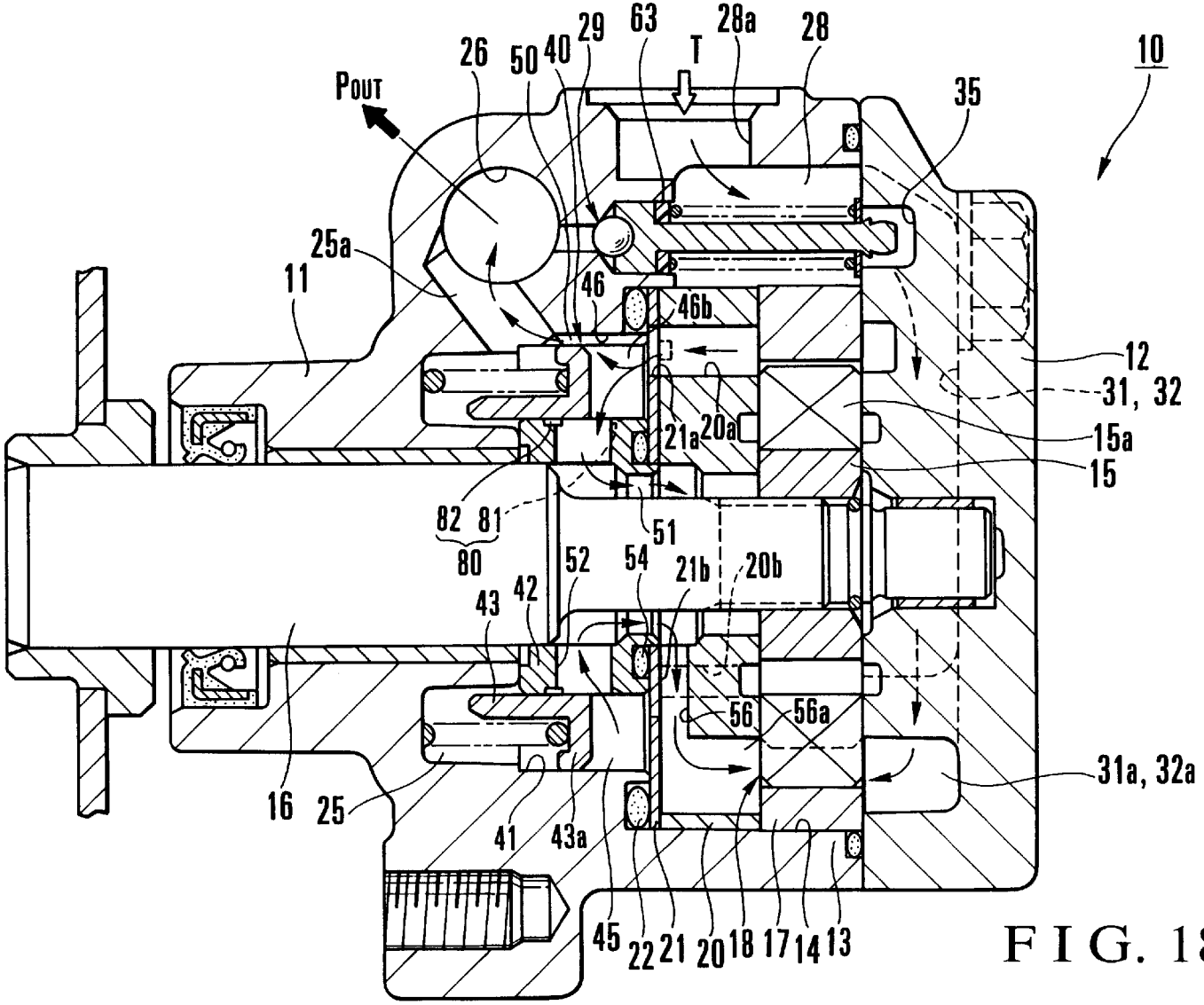
FIG. 18 is a view for explaining the flow of oil that takes place when the pump shifts from idling of FIG. 6 to high-speed rotation.

When the rotational speed of the vehicle engine increases to increase the flow rate of the pump discharge side, the difference between the pressures before and after the restrictor 50 increases, and the annular valve body 43 moves in accordance with the value of the pressure difference against the biasing force of the spring 44. When the annular valve body 43 moves, the path holes 52 formed in the outer surface of the cylindrical member 42 open. The excessive fluid on the pump discharge side flows to a space 51 between the cylindrical member 42 and driving shaft 16 through the path holes 52, and is returned from the excessive fluid introducing openings 56*a* to the pump suction side of the pump chambers 18 through suction paths 56 communicating with the space 51. FIG. 18 shows this state.

With the vane pump 10 of this embodiment as well, the flow control valve 40 is placed in the housing space 14 on the front side of the front body 11, to be located in the annular space 41 formed around the driving shaft 16. When compared to the conventional case wherein the spool is placed in the pump body, close to its outer surface, to be movable in a direction perpendicular to the axial direction, the entire pump can be made compact. Since the members constituting the flow control valve 40 are incorporated in the housing space 14 of the pump constituent elements 13 provided to the front body 11, the pump assembly operation becomes simple, as well as the pump can be made compact, so that the manufacturing cost is reduced.

The restrictor 50 is formed in part of the annular valve body 43 constituting the flow control valve 40. When the annular valve body 43 is moved in the axial direction, the pump discharge fluid can be guided from the path holes 52, formed radially in the cylindrical member 42 fitted on the driving shaft 16, to the pump constituent elements 13 through the space 51 formed along the outer surface of the driving shaft 16, and can be returned to the suction side of the pump chambers 18 through the return path formed of the grooves 56 formed in the pressure plate 20 constituting the pump constituent elements 13. Therefore, with this structure, the operation efficiency of the pump can be greatly improved.

In the arrangement described above, the restrictor 50 through which the rear side and front side of the annular valve body 43 communicate with each other is formed between the groove 60, formed in the inner surface of the front body 11, and the outer surface of the annular valve body 43. When the annular valve body 43 is displaced in the axial direction by the difference between the fluid pressures before and after the restrictor 50 and the biasing force of the coil spring 44, the flow control function of the flow control valve 40 can be effected. Also, the restrictor 50 can be formed simply and appropriately.

The return path for guiding the return fluid (excessive fluid) from the flow control valve 40 to the suction side of the pump chambers 18 is formed in the form of the grooves 56 in the pressure plate 20 constituting the pump constituent elements 13. The return path can thus be formed with a necessary minimum length. This short path reduces the fluid resistance and accordingly the pressure loss. Therefore, the wasteful power loss can be smaller than in the conventional case. In addition, since the return path described above is formed of the grooves 56 formed in the pressure plate 20, and the partition plate 21 for closing the grooves 56, it has a simple structure and can be formed easily.

Since the flow of the excessive fluid can be formed with a short path, an increase in fluid temperature can be reduced, and conventionally required cooling pipes connected to the radiator and the like become unnecessary.

In particular, in this embodiment, the return path for guiding the return fluid (excessive fluid) from the flow control valve 40 to the pump suction side is constituted by the grooves 56, formed in the side surface of the pressure plate 20 on the partition plate 21 side, and the partition plate 21 that closes the grooves 56. Therefore, the structure is simplified, and the respective portions can be formed and assembled easily.

In the above embodiment, the recessed groove 60 which forms the restrictor 50 for actuating the flow control valve 40 is directly formed in the inner circumferential wall of the annular space 41 of the front body 11. However, the present invention is not limited to this. For example, a separate annular cylinder may be fitted on the inner circumferential wall portion of the annular space 41, and a restrictor of the discharge path may be formed of a hole formed between the inner circumferential wall of this annular cylinder and the outer surface of the annular valve body 43, or formed at an appropriate position of the annular valve body 43 other than its outer surface.

The present invention is not limited to the structure of the above embodiment, but the shapes, structures, and the like of the respective portions of the vane pump 10 can be appropriately changed or modified.

In the embodiment described previously, the shapes of the cylindrical member 42, annular valve body 43, path holes 52, and the like constituting the flow control valve 40 as the characteristic features of the present invention may be appropriately changed or modified.

For example, in the embodiment described previously, a step is formed at the inner-diameter portion of the cylindrical member 42. However, the present invention is not limited to this. The cylindrical member 42 may be formed of a simple cylinder the inner and outer diameters of which are predetermined sizes, and the two end portions of the cylindrical member 42 may be sealed with simple surface seals and O-rings interposed between the two end portions of the cylindrical member 42 and the boss 11*c* of the front body 11. With this arrangement, the cylindrical member 42 can be formed easily, and the flow control function is stabilized. This is because the path holes 52 serving as the return holes can be formed highly precisely.

If an O-ring is interposed on the front side of the cylindrical member 42, and the end portion on the rear side of the cylindrical member 42 is urged against the partition plate 21 with the spring force of the O-ring, the pump discharge fluid on the outer surface of the cylindrical member 42 and the pump suction fluid on the inner surface of the cylindrical member 42 can be sealed from each other. A surface to come into contact with the partition plate 21 between the rear-side end portion of the cylindrical member 42 and the annular valve body 43 may be formed with such a precision that assures the surface seal.

Regarding the restrictor 50, it can be formed of a recessed groove formed in the outer surface of the annular valve body 43, so as to define a path together with the inner circumferential wall of the retainer 46 or front body 11. The groove 60 having this recessed shape may be formed with a shape as shown in FIGS. 11A and 11B described above, or an appropriate shape similar to it with which required flow control characteristics can be obtained with the flow control valve 40.

Figure 20:
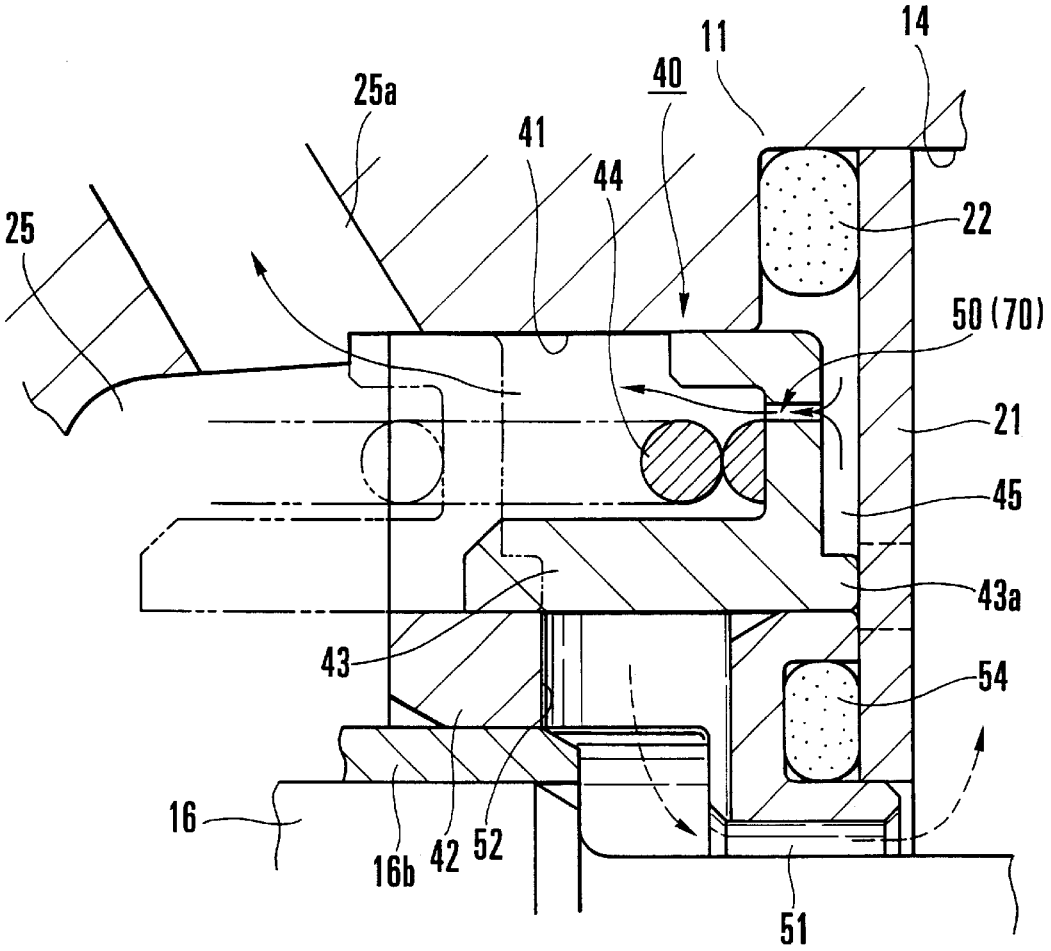
FIG. 20 is an enlarged sectional view of the main part of an oil pump according to still another embodiment of the present invention, to show a portion where a flow control valve is incorporated, and a restrictor for actuating the annular valve body of the flow control valve.

As the restrictor 50 for actuating the flow control valve 40, the structure shown in FIG. 20 may be employed. In this embodiment, a restrictor 50 is formed of a small-diameter hole 70 formed in part of an annular valve body 43. With this arrangement, the restrictor 50 that can appropriately actuate the annular valve body 43 in accordance with the value of the pump discharge flow rate can be formed by simple machining.

In the embodiment of the present invention from FIG. 6, regarding the annular valve body 43 and cylindrical member 42 constituting the flow control valve 40, the plurality of path holes 52 are formed radially in the cylindrical member 42. The return flow channel to the pump suction side for guiding part of the pump discharge fluid in accordance with the motion of the annular valve body 43 has a plurality of chamfers 81 and an annular groove 82. The chamfers 81 are formed at positions different from those of the path holes 52 of the cylindrical member 42. The annular groove 82 is formed in the outer surface of the cylindrical member 42 such that the downstream sides of the chamfers 81 communicate with each other. When the annular groove 82 communicates with the path holes 52 from the downstream side, the length of the communication path 80 to be connected to the return path through the path holes 52 in the flow control valve 40 can be maximized. When the return fluid pressure is gradually decreased, cavitation can be prevented, thereby preventing noise.

However, the present invention is not limited to this. A structure which directly communicates with the path holes 52 of the cylindrical member 42 may be formed, like the chamfers of the embodiment shown in FIGS. 1 to 5C.

In the above embodiment, the grooves 56 are formed in the front-side side surface of the pressure plate 20, and are covered with the partition plate 21, to form the return path to the suction side. However, the present invention is not limited to this. Grooves may be formed in the pressure plate 20 to omit the partition plate 21.

In the above embodiments, the relief valve 29 or 62 is incorporated in the valve hole formed in the pump body (mainly the front body 11). However, the present invention is not limited to this. From the viewpoint of easy formation and assembly, a relief valve unit may be incorporated in a plug member, and the plug member may be incorporated in a mounting hole open outside the pump body. In the relief vale 62, the structures of the spring retainer 62*f* and locking projection 62*g* are not limited to those described above, but an appropriate locking member may be used.

The vane pump 10 having the arrangement described above is not limited to the structure shown in the above embodiments. The vane pump 10 can be applied to various types of equipments and apparatuses other than the power steering device described above. For example, the above embodiments exemplify the vane pump 10. However, the present invention is not limited to this, but can be applied to an oil pump in which a pump element similar to vanes is movably provided to the rotor, as shown in, e.g., Japanese Patent Publication No. 52-10202.

When an oil pump of this type is used as an oil pressure generating source for a power steering device and is mounted in a vehicle, for the sake of convenience, the portion located on the front side in the pump body of the vehicle is called the front body, and the portion located on the rear side is called the rear body. Therefore, in this specification, the front body side of the pump body is called the front side, and the rear body side of the pump body is called the rear side. The direction (the axial direction of the driven shaft) along which an oil pump is to be mounted in the vehicle is determined in accordance with the type of the vehicle and the direction of the engine. Hence, the terms "front" and "rear" used in this specification do not limit the scope of the present invention.

For example, in the flow control valve 40 of the embodiment described with reference to FIGS. 1 to 5C, if the annular valve body 43 has an outer diameter of 50 mm and an inner diameter of 25 mm, the pressure-receiving area which receives the oil pressure is 14.7 $cm^2$. Note that the difference between the pressures before and after flow rate adjustment by the restrictor 50 is 1 $kg/cm^2$, and that the employed maximum pressure is 100 $kg/cm^2$.

Under these conditions, when the adjusted flow rate increases, the difference between the pressures before and after the restrictor 50 increases. If the pressure difference is 1 $kg/cm^2$ or more, the annular valve body 43 moves on the cylindrical member 42 against the biasing force of the coil spring 44, to open the path holes 52 on the cylindrical member 42. In this case, the spring load is 14.7 $cm^2 \times 1$ $kg/cm^2$=14.7 kgf.

In the flow control valve 40, assume that the pressure-receiving area differs before and after the restrictor 50 of the annular valve body 43.

If the inner diameter of the annular valve body 43 is 25.5 mm, which is different by about 0.5 mm, the difference in pressure-receiving area before and after the restrictor 50 is $\pi/4\ (2.55^2-2.5^2)=0.2\ cm^2$.

Under this condition, assume that the power steering device is actuated to increase the oil pressure after the restrictor 50 to 100 $kg/cm^2$, and that the difference between the pressures before and after the restrictor 50 is 1 $kg/cm^2$. Then, a thrust of about 5 kgf is generated in the annular valve body 43. This thrust is added to the spring load to push the annular valve body 43 with a force of 14.7 kgf+5 kgf.

Accordingly, the flow rate of the fluid flowing through the restrictor 50 increases, and the adjusted flow rate is increased to, e.g., 14.7 kgf+5 kgf=19.7 kgf, until a pressure difference load of about 1.3 times is generated.

Even with this very small pressure-receiving area, if the pressure is high, the adjusted flow rate fluctuates largely. Accordingly, the conventionally widely-known structure as those shown in, e.g., Japanese Patent Publication No. 52-10202 and Japanese Patent Laid-Open No. 47-9077, is not practical. More specifically, as described in the above embodiment, to set the pressure-receiving areas at the two end sides, in the axial direction, of the annular valve body 43 to be equal to or almost equal to each other is significant in obtaining a required pump operation.

As has been described above, in the oil pump according to the present invention, the annular space for incorporating the flow control valve is formed around the driving shaft in the pump body, and the flow control valve is actuated by axial displacement of the annular valve body placed in the annular space. As compared to the conventional case wherein the flow control valve, having a spool movable in the direction perpendicular to the axial direction of the driving shaft, is built on the outer surface of the pump body, a compact pump can be made.

In particular, according to the present invention, since the flow control valve is arranged on the driving shaft of the pump to be aligned side by side with the bearing and the pump constituent elements, the flow control valve incorporated structure can be made compact compared to the conventional one. Furthermore, according to the present invention, since the flow control valve can be assembled together with the pump constituent elements, the assembly is easy, and the manufacturing cost can be reduced.

According to the present invention, since the annular valve body constituting the flow control valve is disposed at a position opposing the discharge port of the pump chamber constituted by the pump constituent elements, the excessive fluid on the pump discharge side can be returned from the pump discharge side to the pump suction side through the shortest return path. Since the return path is very short, the flow resistance on the return path extending from the pump discharge side to the pump suction side decreases, to accordingly decrease the power loss. As a result, the operation efficiency of the pump can be improved greatly.

According to the present invention, the annular valve body is slidably fitted on the cylindrical surface of the cylindrical member, and the path holes serving as the return holes for the excessive fluid are formed in the cylindrical surface of the cylindrical member. Therefore, the area for receiving the pressure at the upstream side of the restrictor of the annular valve body and the area for receiving the pressure at the downstream side can be set completely equal to each other. Even if the pressure of the pump discharge fluid increases during actuation of the power steering device, the force acting on the annular valve body is canceled. A force other than the difference between the pressures before and after the restrictor does not act on the annular valve body, and the control flow rate does not vary.

In the oil pump according to the present invention, paths for guiding the suction fluid from the tank and the excessive fluid from the flow control valve to the suction side of the pump chambers are separated. The suction fluid and the excessive fluid are separately taken into the pump chambers through the suction openings and excessive fluid introducing openings respectively formed in the plate portions (the rear body and the pressure plate) arranged on the two sides of the rotor and cam ring that form the pump chambers. The suction fluid and the excessive fluid do not merge before being taken into the pump chambers. An insufficient suction flow rate on the suction side of the pump chambers due to collision between these fluids in the suction path to form a negative-pressure region, thus causing cavitation can be prevented.

Therefore, according to the present invention, even when the rotational speed of the pump increases to reach a high speed, the flow rate of the excessive fluid increases, and the flow velocity increases, cavitation and resultant noise can be prevented reliably.

According to the present invention, the excessive fluid return path formed of a groove, and a discharge path located at a position different from the return path, can be sealed from each other by the partition plate stacked on the pressure plate. Since this partition plate is employed, the pressure plate can be formed easily, thus reducing the cost.

What is claimed is:

1. An oil pump comprising:

pump constituent elements constituted by a rotor, a cam ring for housing said rotor to define a pump chamber together with said rotor, and a pressure plate disposed at least on one side of said rotor and said cam ring;

a pump body constituted by a front body, which defines a housing space for housing said pump constituent elements, and a rear body; and a driving shaft extending through and axially supported by said front body to rotatably drive said rotor, wherein an annular space is formed around said driving shaft in said front body on a front side of said housing space, and a flow control valve is placed in said annular space to return part of a pump discharge fluid from said pump chamber to a pump suction side.

2. A pump according to claim 1, wherein said front body has said housing space for housing said pump constituent elements, a discharge pressure chamber on the front side of said housing space, to which the pump discharge fluid from said pump chamber is guided and which is connected to a discharge port through a discharge path formed in said front body, and said annular space for said flow control valve, said annular space being formed adjacent to said discharge pressure chamber between said discharge pressure chamber and said housing space.

3. A pump according to claim 1, wherein said flow control valve comprises a cylindrical member fitted around said driving shaft, an annular valve body formed on an outer surface of said cylindrical member to be movable in an axial direction, and biasing member for biasing said annular valve body toward said housing space of said pump constituent elements, said pump further comprises a restrictor formed on each of two end sides, in an axial direction, of said annular valve body to allow side portions on said two end sides of said annular valve body to communicate with each other, and said cylindrical member has a path hole for returning the pump discharge fluid to the pump suction side by displacement of said annular valve body in an axial direction.

4. A pump according to claim 3, wherein said cylindrical member has an excessive fluid communication path, a path sectional area of which gradually increases to guide the pump discharge fluid to said path hole before said path hole communicates upon displacement of said annular valve body in the axial direction.

5. A pump according to claim 4, wherein said excessive fluid communication path has an axial path formed in an outer surface of said cylindrical member at a position shifted from said path hole in said outer surface of said cylindrical member in a rotational direction, so that the pump discharge fluid flows into said path before said path hole communicates upon displacement of said annular valve body in the axial direction, and a circumferential path formed in said outer surface of said cylindrical member so as to connect said axial path and said path hole to each other.

6. A pump according to claim 3, wherein said side portions, on said two end sides in the axial direction, of said annular valve body have pressure-receiving areas almost equal to each other.

7. A pump according to claim 3, wherein said restrictor is formed between an inner circumferential wall of said annular space in said front body, or an inner surface of a retainer fitted in said annular space, and an outer surface of said annular valve body.

8. A pump according to claim 7, wherein said restrictor has such a shape that a restricting amount changes in accordance with motion of said annular valve body.

9. A pump according to claim 3, wherein said restrictor has a small-diameter hole formed in part of said annular valve body.

10. A pump according to claim 3, wherein said pump constituent elements have a pressure plate stacked on a discharge pressure chamber side of said rotor and said cam ring, said pressure plate having a groove for guiding a return fluid, guided by said path hole of said cylindrical member, to the pump suction side of said pump chamber.

11. A pump according to claim 10, wherein said groove constituting said return path is formed in a side portion, on a flow control valve side, of said pressure plate, and a partition plate for closing said groove is stacked on said pressure plate.

12. An oil pump comprising;

pump constituent elements for defining a pump chamber between a rotor and a cam ring that houses said rotor;

a pump body comprising a front and rear body, said pump body for causing a pressure plate and said rear body to oppose each other on two sides of said pump constituent elements, wherein the pump body defines a housing space for housing said pump constituent elements; and a flow control valve for returning part of a discharge fluid discharged from a discharges side of said pump chamber to a suction side as an excessive fluid, wherein suction openings for guiding a suction fluid from a tank to a suction side of said pump chamber are formed in an end face of said rear body, an excessive fluid introducing opening for returning the excessive fluid to the suction side of said pump chamber is formed in an end face of said pressure plate;

a driving shaft extending through and axially supported by said front body to rotatably drive said rotor;

wherein an annular spaces is formed around said driving shaft in said front body on a front side of said housing space, wherein said flow control valve is placed in said annular space to return part of pump discharge fluid from said pump chamber to said pump suction side.

13. An oil pump comprising:

pump constituent elements for defining a pump chamber between a rotor and a cam ring that houses said rotor;

a pump body for defining a housing space that houses said pump constituent elements, wherein said pump body defines a front body, a discharge pressure chamber formed in said pump body to guide a discharge fluid discharges from said pump chamber so as to discharge the discharge fluid from a discharge port through a discharge path;

a flow control valve connected to part of said discharge path to return part of the discharge fluid to an excessive fluid return path when a flow rate of the discharge fluid is not less than a redetermined valve;

a suction path for guiding a suction fluid from a suction port formed in said pump body to a suction side of said pump chamber;

a pressure plate stacked, on one side of said rotor and said cam ring, on a discharge pressure chamber;

a rear body arranged on the other side of said rotor and said cam ring to be integral with or separate from said pump body, said rear body being formed with a suction opening for guiding the suction fluid into said pump clamber, wherein said pressure plate is formed with a groove to serve as a return path for guiding an excessive fluid, returned to the suction side through said flow control valve, to the suction side of said pump chamber, said groove has an excessive fluid introducing opening formed at a position opposing said suction opening of said rear body;

a driving shaft extending through and axially supported by the front body to rotatably drive said rotor an annular spaces is formed around said driving shaft in said front body on a front side of said housing space, and wherein the flow control valve is placed in said annular space to return part of pump discharge fluid from said pump chamber to a pump suction side.

14. A pump according to claim 13, wherein said pressure plate has a through hole constituting part of a discharge path that guides the discharge fluid from the discharge side of said pump chamber to said discharge pressure chamber, said groove constituting said return path is formed in a surface of said pressure plate on a side opposite to said pump chamber, and a partition plate for closing said groove is stacked on said pressure plate.

* * * * *